US009613605B2

(12) United States Patent
Brewer

(10) Patent No.: US 9,613,605 B2
(45) Date of Patent: Apr. 4, 2017

(54) METHOD, DEVICE AND SYSTEM FOR AUTOMATICALLY ADJUSTING A DURATION OF A SONG

(71) Applicant: tuneSplice LLC, Arlington, VA (US)

(72) Inventor: Paul Brewer, Arlington, VA (US)

(73) Assignee: TUNESPLICE, LLC, Arlington, VA (US)

( * ) Notice: Subject to any disclaimer, the term of this patent is extended or adjusted under 35 U.S.C. 154(b) by 0 days.

(21) Appl. No.: 14/252,573

(22) Filed: Apr. 14, 2014

(65) Prior Publication Data

US 2015/0128788 A1 May 14, 2015

Related U.S. Application Data

(60) Provisional application No. 61/903,960, filed on Nov. 14, 2013.

(51) Int. Cl.
*G10H 7/00* (2006.01)
*G10H 1/00* (2006.01)

(52) U.S. Cl.
CPC ..... *G10H 1/0008* (2013.01); *G10H 7/00* (2013.01); *G10H 2210/061* (2013.01); *G10H 2210/125* (2013.01); *G10H 2240/141* (2013.01)

(58) Field of Classification Search
CPC ..... G10H 7/00
USPC ..... 84/600–601
See application file for complete search history.

(56) References Cited

U.S. PATENT DOCUMENTS 4,969,384 A * 11/1990 Kawasaki ..... G10H 1/26 84/612
5,494,443 A * 2/1996 Nakai ..... G10H 1/0066 434/307 A
5,693,902 A * 12/1997 Hufford ..... G06F 17/30017 707/E17.009
6,211,453 B1 * 4/2001 Kurakake ..... G10H 1/26 84/477 R
6,835,885 B1 * 12/2004 Kondo ..... G10H 1/40 84/612
6,944,510 B1 * 9/2005 Ballesty ..... G10L 21/04 381/119
7,038,118 B1 * 5/2006 Gimarc ..... G06Q 30/0264 700/94
7,612,279 B1 11/2009 Schnepel et al.
7,668,610 B1 * 2/2010 Bennett ..... G10H 1/0008 700/94
7,826,911 B1 * 11/2010 Bennett ..... G06F 17/30743 700/94
7,948,981 B1 * 5/2011 Schnepel ..... G10H 1/0025 370/235

(Continued)

OTHER PUBLICATIONS

U.S. Appl. No. 11/585,352, filed Oct. 23, 2006.

*Primary Examiner* — David Warren
(74) *Attorney, Agent, or Firm* — Muir Patent Law, PLLC

(57) ABSTRACT

Methods, systems and devices may automatically determine splice points within a song to alter a length of the song. Possible splice points may be obtained by comparing different portions of the song with each other. After obtaining possible splice points, the song may be shortened by deleting/skipping portions of the song between two paired splice points. Alternatively the song may be lengthened. The altered song may be used with an audio-visual presentation, such as a slide show or commercial, or as a ringtone.

37 Claims, 24 Drawing Sheets

(56) References Cited

U.S. PATENT DOCUMENTS 8,115,090 B2 * 2/2012 Miyajima ..... G10H 1/0025 84/625
8,357,847 B2 * 1/2013 Huet ..... G10H 1/0025 84/609
8,492,637 B2 * 7/2013 Miyajima ..... G10H 1/0025 84/609
8,525,012 B1 * 9/2013 Yang ..... G10H 1/08 700/94
8,847,053 B2 * 9/2014 Humphrey ..... G09B 5/065 434/308
8,977,374 B1 * 3/2015 Eck ..... G10L 25/63 700/94
9,317,561 B2 * 4/2016 Resch ..... G06F 17/3053
2003/0084459 A1 * 5/2003 Buxton ..... G06F 17/30017 725/135
2004/0159221 A1 * 8/2004 Camiel ..... G10H 1/0041 84/660
2004/0255759 A1 * 12/2004 Gayama ..... G10H 1/383 84/613
2005/0137729 A1 * 6/2005 Sakurai ..... G10L 21/04 700/94
2005/0137730 A1 * 6/2005 Trautmann ..... G11B 27/005 700/94
2006/0210157 A1 * 9/2006 Agnihotri ..... G06F 17/30793 382/173
2007/0261537 A1 * 11/2007 Eronen ..... G10H 1/40 84/611
2008/0092721 A1 * 4/2008 Schnepel ..... G10H 1/0025 84/609
2008/0140236 A1 * 6/2008 Nonaka ..... G10H 1/0008 700/94
2008/0190268 A1 * 8/2008 McNally ..... G10H 1/0025 84/609
2009/0029685 A1 * 1/2009 Willis ..... H04L 67/04 455/414.1
2009/0038468 A1 * 2/2009 Brennan ..... G09B 5/06 84/609
2009/0062942 A1 * 3/2009 Smaragdis ..... G06F 17/30743 700/94
2009/0133568 A1 * 5/2009 Miyajima ..... G10H 1/0025 84/625
2009/0286560 A1 * 11/2009 Willis ..... G06F 17/30017 455/466
2009/0287323 A1 * 11/2009 Kobayashi ..... G10H 1/0008 700/94
2010/0057232 A1 * 3/2010 Glatt ..... G10H 1/0025 700/94
2010/0198760 A1 * 8/2010 Maddage ..... G06F 17/30758 706/12
2010/0273610 A1 * 10/2010 Johnson ..... A63B 24/0075 482/9
2010/0322042 A1 * 12/2010 Serletic ..... G06F 3/0481 369/1
2011/0112672 A1 * 5/2011 Brown ..... G10H 1/0025 700/94
2011/0131493 A1 * 6/2011 Dahl ..... G06F 17/30029 715/716
2013/0275421 A1 * 10/2013 Resch ..... G10H 1/0008 707/725
2014/0076125 A1 * 3/2014 Kellett ..... G10H 7/00 84/609
2014/0180674 A1 * 6/2014 Neuhauser ..... G10L 25/81 704/9
2014/0330556 A1 * 11/2014 Resch ..... G10L 19/00 704/221
2014/0338515 A1 * 11/2014 Sheffer ..... G10H 1/36 84/609
2015/0039541 A1 * 2/2015 Kapur ..... G06N 99/005 706/12
2015/0066481 A1 * 3/2015 Terrell ..... G06F 17/28 704/9
2015/0094835 A1 * 4/2015 Eronen ..... G06F 3/165 700/94
2015/0128788 A1 * 5/2015 Brewer ..... G10H 1/0008 84/609
2015/0310891 A1 * 10/2015 Pello ..... G11B 20/10527 369/47.16
2016/0124953 A1 * 5/2016 Cremer ..... G06F 17/30864 715/203

* cited by examiner

FIG. 10

1st derivative $$\frac{\partial f}{\partial x} = \frac{f(x+\Delta x) - f(x)}{\Delta x} = f(x+1) - f(x)$$

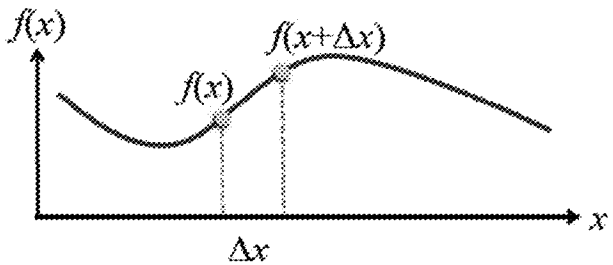

2nd derivative $$\frac{\partial^2 f}{\partial x^2} = \frac{f(x+\Delta x) + f(x-\Delta x) - 2f(x)}{\Delta x^2}$$

$$\frac{\partial^2 f}{\partial x^2} = f(x+1) + f(x-1) - 2f(x)$$

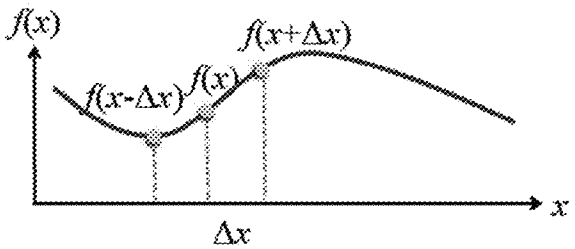

Compute the 1st and 2nd derivatives of the matching window region to determine best matching local peaks or zero crossings with a good local area match.

FIG. 11A

| Song Identification | Shortened Length | Shortening Information |
|---|---|---|
| "Song A" | 2:50 | Info A1 |
| | 2:22 | Info A2 |
| | 1:47 | Info A3 |
| | 1:44 | Info A4 |
| | 1:39 | Info A5 |
| | 1:14 | Info A6 |
| "Song B" | 3:44 | Info B1 |
| | 2:37 | Info B2 |
| | 2:26 | Info B3 |

112 114 116 110

FIG. 11B 112 114 116 118 120

110

| Song Identification | Shortened Length | Shortening Information | Positive Rating | Negative Rating |
|---|---|---|---|---|
| "Song A" | 2:50 | Info A1 | 44 | 0 |
| | 2:22 | Info A2 | 7 | 43 |
| | 1:47 | Info A3 | 3 | 24 |
| | 1:44 | Info A4 | 54 | 0 |
| | 1:39 | Info A5 | 24 | 4 |
| | 1:14 | Info A6 | 91 | 0 |
| "Song B" | 3:44 | Info B1 | 49 | 4 |
| | 2:37 | Info B2 | 3 | 114 |
| | 2:26 | Info B3 | 55 | 17 |

| Duration (sec) | T1 | T2 | Quality |
|---|---|---|---|
| 163 | 220 | 141.951315 | 9.375 |
| 163 | 215 | 136.951315 | 9.077 |
| 163 | 210 | 131.951315 | 9.064 |
| 163 | 225 | 146.951315 | 8.895 |

METHOD, DEVICE AND SYSTEM FOR AUTOMATICALLY ADJUSTING A DURATION OF A SONG

RELATED APPLICATION

This application claims priority to and is a non-provisional of provisional application Ser. No. 61/903,960, filed Nov. 14, 2013, the entire contents of which are incorporated by reference in their entirety.

BACKGROUND

Inexpensive and even free desktop, web-based and mobile movie editing suites let ordinary people commemorate and celebrate vacations, sports seasons, and anniversaries by setting their pictures and videos to music.

Amateur video slideshow producers generally add songs that convey some message or have particularly relevant lyrics. When creating video slideshows, users run into a recurring problem: Songs can often be too long for that format. Long songs make the overall video too long. Or users run out of content to fit the full length of a particular song.

To solve this problem, amateur video slideshow producers generally cut the song wherever convenient and fade out before fading into or starting a new song. This technique, while easy to do, generally produces an amateurish result. More skilled users, who are comfortable with audio editing software, can listen to a song to find sections of the song that sound similar or almost identical one another, find and study waveforms associated with these sections to splice out (e.g., delete) the section of music in between the two splice points. While this is likely within the skill of a professional audio engineer, it is generally beyond the abilities of all but the most skilled of amateurs. In addition, it requires both listening to a song to identify which portions of the song waveform should be studied, and studying the waveforms to identify matches—a process that takes a skilled audio engineer a significant amount of time.

SUMMARY

Embodiments described herein include a methods, devices and systems for automatically identifying segments of similar audio content in songs, identifying the best point at which to splice a song, and that then splices the song to adjust the length or duration of the song. For example, portions may be automatically deleted from a song to create a shortened version of the song that retains the beginning, a middle and the end. The song duration may be changed without requiring the song to be listened to.

In some embodiments, a method of altering a duration of a song comprises receiving a request to alter a duration of a first song, the first song being stored as a first digital file; automatically analyzing the first song to determine one or more pairs of splice locations within the first song including comparing one or more portions of the first digital file with a remainder of the first digital file; altering the duration of the first song in response to a selection of at least a first pair of splice locations of the one or more pairs of splice locations.

Automatically analyzing may include comparing a first portion of the first digital file with plural parts of a remaining portion of the first digital file to determine a plurality of similarity values, each similarity value representing a degree of similarity of the first portion with a corresponding part of the remaining portion.

Automatically analyzing may include determining for each of the plurality of similarity of values an associated locational relationship between the first portion and one of the plural parts of the remaining portion of the first digital file Each of the plurality of similarity values may be determined by an extent of overlap of an area of the first portion of the first digital file with an area of a corresponding one of the plural parts of the remaining portion of the first digital file.

Each of the plurality of similarity values may be determined by performing a cross correlation calculation with the first portion of the first digital file and the remaining portion.

Each of the plurality of similarity values may be determined by determining a shared area of a waveform corresponding to the first portion of the first digital file and waveforms corresponding to a respective one of the plural parts of the remaining portion of the first digital file.

Altering the duration of the first song may include providing a second digital file comprised of the first digital file with a portion of the first digital file between a selected pair of splice locations removed.

Altering the duration of the first song may include providing instructions for playing the first song, including skipping a portion of the first song between a selected pair of splice locations.

Altering the duration of the first song may include lengthening the first song by providing a second digital file comprised of the first digital file with a portion of the first digital file between a selected pair of splice locations duplicated.

Altering the duration of the first song may include providing instructions for playing the first song, including duplicating a portion of the first song between a selected pair of splice locations.

Some disclosed embodiments include receiving a request to alter a duration of a group of songs, including the first song, each song of the group of songs being stored as a digital file; for each of the group of songs, automatically analyzing each song of the group of songs to determine one or more pairs of splice locations within each song including comparing one or more portions of the corresponding digital file with a remainder of the corresponding digital file; altering the duration of the group of songs by altering the duration of at least the first song in response to a selection of the first pair of splice locations within the first song.

Methods may further comprise altering the duration of at least the first song and a second song of the group of songs in response to a selection of at the first pair of splice locations within the first song and in response to a selection of a second pair of splice locations within the second song.

Methods may further comprise receiving a user input reflecting a duration, wherein the selection of the first pair of splice locations within the first song and the selection of the second pair of splice locations within the second song is automatically performed in response to the duration.

The user input may be a duration value or one or more parameters from which the duration is calculated.

Altering the duration of the group of songs may comprise altering the duration of the group of songs to approximate or equal the duration.

Methods may further comprise associating the group of songs with altered duration to one or more of video and image files.

Methods may further comprise creating a slide show using the group of songs with altered duration.

Methods may further comprise creating plural versions of the first song with an altered duration, each version corresponding to a different pair of splice locations of the one or more splice locations; receiving one or more ratings from one or more users of at least one of the plural versions indicating a quality of the at least one of the plural versions.

Methods may further comprise providing a list of the plural versions of the first song with an altered duration, the list being responsive to the one or more ratings of the one or more users.

The order of the list may be responsive to the one or more ratings of the one or more users.

Each entry of the list may include a version indicator associated with a corresponding version of the first song with an altered duration, and a quality value associated with the version indicator. The quality value may be responsive to the one or more ratings of the one or more users.

The user rating may comprise a user selection of one of a positive icon and a negative icon via user interface.

Methods may further comprise altering the duration of the first song by repeating the first song between the pair of splice locations.

Methods may further comprise playing with a phone the first song of altered duration as a ringtone upon receiving a phone call.

Methods may further comprise providing information to display the one or more pairs of splice locations to a user; and receiving a selection of a pair of splice locations from a user.

Methods may further comprise providing display information comprising a timeline representation of the song and a plurality of splice location indicators associated with the timeline representation of the song; and receiving a selection of two of the splice location indicators.

Methods may further comprise receiving a user input responsive to a user manipulation of a cursor to match two of the splice location indicators.

The step of automatically analyzing the first song may be performed prior to receiving the request to alter the first song and wherein altering the duration of the first song in response to the selection is performed without reanalyzing the first song.

Methods may further comprise automatically analyzing a plurality of songs, including the first song, to determine, for each song, at least one version of the corresponding song having an altered duration and storing altered song duration information corresponding to each version; and then receiving the request to alter a duration of the first song; and then providing altered song duration information of the first song.

The altered song duration information may comprise a quality ranking User feedback may be received regarding a version of a song having an altered duration and changing a quality ranking in response to the user feedback.

Automatically analyzing may include comparing a plural portions of the first digital file with plural parts of a remaining portion of the first digital file to determine, for each portion of the first digital file, a plurality of similarity values, each similarity value representing a degree of similarity of the corresponding portion with a corresponding part of the remaining portion.

Methods may further comprise comparing plural pairs of splice locations to determine similar pairs of splice locations. Determining similar pairs of splice locations may comprise determining a segment duration between each pair of splice locations and comparing the determined segment durations.

Methods may also comprise clustering similar pairs of splice locations into a pair of splice objects. Selection of the first pair of splice locations may comprise selecting the pair of splice objects.

Methods may comprise providing a list of pairs of splice locations, and clustering may comprise providing only one of the similar pairs of a splice object in the list.

Embodiments contemplate a non-transitory, tangible, computer readable storage medium comprising a program that when executed by a computer system performs one or more of the methods described herein.

Embodiments contemplate a processor configured to perform one or more of the methods described herein. Embodiments may comprise a computer system configured execute programs stored in the non-transitory, tangible, computer readable storage medium to execute one or more of the methods described herein.

Example embodiments will be more clearly understood from the following brief description taken in conjunction with the accompanying drawings. The accompanying drawings represent non-limiting, example embodiments as described herein.

BRIEF DESCRIPTION OF THE DRAWINGS

FIG. 8 illustrates two parts of the song waveform that are similar.

FIG. 10 illustrates an exemplary method to perform fine matching to determine splice points.

FIGS. 11A, 11B and 11C illustrate details regarding a database which may be displayed to a user.

DETAILED DESCRIPTION

Figure 1A:
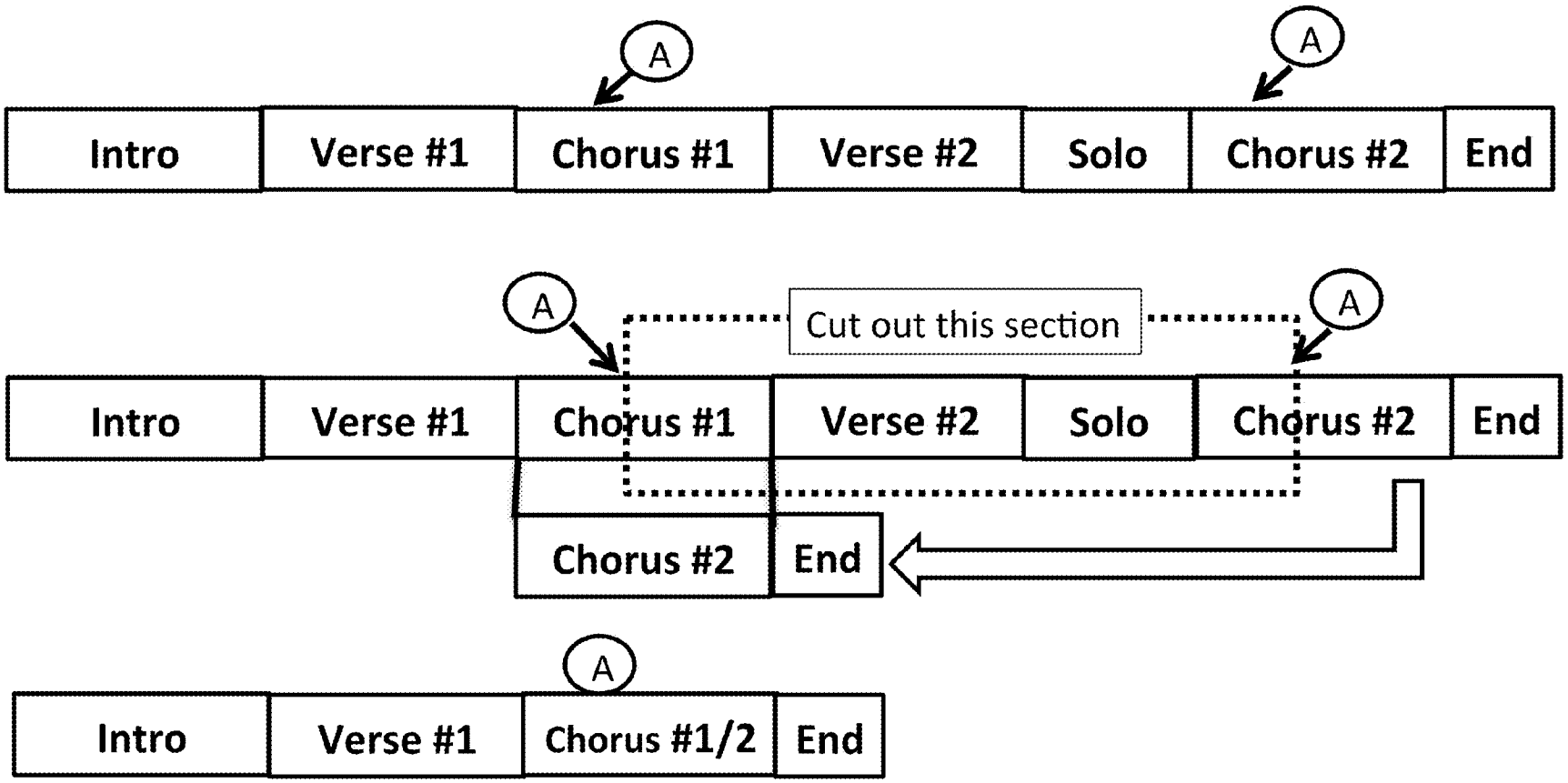
FIG. 1A illustrates the structure of a typical song.

Various exemplary embodiments will be described more fully hereinafter with reference to the accompanying drawings, in which some exemplary embodiments are shown. The present invention may, however, be embodied in many different forms and should not be construed as limited to the example embodiments set forth herein. These example embodiments are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention. In the drawings, the sizes and relative sizes of layers and regions may be exaggerated for clarity. Like numerals refer to like elements throughout, and thus repetitive description may be omitted.

When an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements or layers should be interpreted in a like fashion (e.g., "between" versus "directly between," "adjacent" versus "directly adjacent," "on" versus "directly on"). As used herein the term "and/or" includes any and all combinations of one or more of the associated listed items.

Although the terms "first", "second", etc. may be used herein to describe various elements, components, sections, etc., which should not be limited by these terms. Unless indicated otherwise, these terms are only used to distinguish one element, component, section, etc. from another. Thus, a first element, component, region, or section could be termed a second element, component, region, or section without departing from the teachings of example embodiments.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

"Splice point" as used herein refers to an identified location within a song (i.e., a time from the beginning of the song or other time marker) that identifies an option to delete or add other portions of the song after that spice point (to provide a song having a different length).

"Paired splice points" or "Grouped splice points" (or similar language, such as "pairs of splice points" or "groups splice points") refers to two or more splice points relating to each other due to similarity of the song at these splice points. Paired splice points or two splice points of a group may be used to locate portions of a song for splicing.

"Splicing" refers to the process of joining different portions of a song together that may result in a shorter or longer song. The resulting spliced song may take the form of a new digital representation of a song (e.g., a new digital music file representing the altered song). Alternatively, the spliced song may take the form of instructions to play a particular sequence of identified portions of the original song with (e.g., a pointer list to indexed time locations of the song).

"Slide show" refers to a visual presentation, that may comprise the display of one or more still pictures and/or video. The slide show may also comprise background music such as one or more songs.

"Waveform" is the representation of an amplitude of a signal over time. A waveform may be digital or analog.

"Audio Waveform" is a waveform of an audio signal. The audio signal may represent a voltage signal or an acoustic vibration, for example.

"Similar waveforms" refers to waveforms that are determined to meet a certain threshold of likeness. Similar waveforms may be identical waveforms.

Locational terms, such as "location" or "point" with respect to a song or song waveform indicates a location, point, etc. along the x-axis and may represent a time value, such as a time from the beginning of a song.

"Song" refers to a musical composition. A song may include only instrumental music, may include only vocals or may include a combination of vocals and instruments. A song may comprise a musical composition of audio recordings (such as recordings of birds, the ocean, traffic, etc.).

A "computer" refers to one or more apparatus and/or one or more systems that are capable of accepting a structured input, processing the structured input according to prescribed rules, and producing results of the processing as output. Examples of a computer may include: a computer; a stationary and/or portable computer; a computer having a single processor, multiple processors, or multi-core processors, which may operate in parallel and/or not in parallel; a general purpose computer; a supercomputer; a mainframe; a super mini-computer; a mini-computer; a workstation; a micro-computer; a server; a client; an interactive television; a web appliance; a telecommunications device with internet access; a hybrid combination of a computer and an interactive television; a portable computer; a tablet personal computer (PC); a personal digital assistant (PDA); a portable telephone; application-specific hardware to emulate a computer and/or software, such as, for example, a digital signal processor (DSP), a field-programmable gate array (FPGA), an application specific integrated circuit (ASIC), an application specific instruction-set processor (ASIP), a chip, chips, or a chip set; a system on a chip (SoC), or a multiprocessor system-on-chip (MPSoC); an optical computer; a quantum computer; a biological computer; and an apparatus that may accept data, may process data in accordance with one or more stored software programs, may generate results, and typically may include input, output, storage, arithmetic, logic, and control units.

"Software" refers to prescribed rules to operate a computer. Examples of software may include: software; code segments; instructions; applets; pre-compiled code; compiled code; interpreted code; computer programs; and programmed logic.

A "computer-readable medium" refers to any storage device used for storing data accessible by a computer. Examples of a computer-readable medium may include: a magnetic hard disk; a floppy disk; an optical disk, such as a CD-ROM and a DVD; a magnetic tape; a flash removable memory; a memory chip; and/or other types of media that can store machine-readable instructions thereon.

A "computer system" refers to a system having one or more computers, where each computer may include a computer-readable medium embodying software to operate the computer. Examples of a computer system may include: a distributed computer system for processing information via computer systems linked by a network; two or more computer systems connected together via a network for transmitting and/or receiving information between the computer systems; and one or more apparatuses and/or one or more systems that may accept data, may process data in accordance with one or more stored software programs, may generate results, and typically may include input, output, storage, arithmetic, logic, and control units.

A "network" refers to a number of computers and associated devices that may be connected by communication facilities. A network may involve permanent connections such as cables or temporary connections such as those made through telephone or other communication links. A network may further include hard-wired connections (e.g., coaxial cable, twisted pair, optical fiber, waveguides, etc.) and/or wireless connections (e.g., radio frequency waveforms, free-space optical waveforms, acoustic waveforms, etc.). Examples of a network may include: an internet, such as the Internet; an intranet; a local area network (LAN); a wide area network (WAN); and a combination of networks, such as an internet and an intranet. Exemplary networks may operate with any of a number of protocols, such as Internet protocol (IP), asynchronous transfer mode (ATM), and/or synchronous optical network (SONET), user datagram protocol (UDP), IEEE 802.x, etc.

Embodiments described herein include a method, device and system for automatically adjusting a length of a song. Embodiments of device and systems disclosed herein may be configured to implement the methods, and methods of the embodiments may be described with respect to the disclosed device and systems. For example, disclosed embodiments may identify segments of similar audio content in a song, identifying the best point at which to splice a song, and splice the song to adjust the length of the song. For example, portions may be automatically deleted from a song to create a shortened version of the song while still retaining the beginning, a middle portion and the end of the song. By maintaining the beginning and end of the song, a shortened version may avoid annoying cutoffs (e.g., fadeouts) in the middle of the song while still shortening the length of the song. Similarly, a song may be automatically lengthened without noticeable detection by a listener by splicing portions of a song together at automatically detected splice points within the song.

Automatically adjusting the length of a song is useful for many applications. For example, in creating slide shows to share pictures (e.g., for kids' sports functions, family vacations, parties, etc.) a certain amount of time may be appropriate for the slide show (e.g., 5 minutes). In adding background music to the slideshow, songs are often undesirably long for the slide show—a user may wish to add multiple songs to match different themes of the slide show, to remind the listener of some experience relating to the song (e.g., favorite songs of a trip, friends, a team, etc.) or simply to create more musical diversity for the slide show to make the slide show more interesting. However, as modern song lengths (e.g., song lengths of pop, rock, hip hop songs) are typically at least three minutes or more (often in the range of 3 to 5 minutes, many over 5 minutes), using desired songs as background music for a slide show of limited length (e.g., 5 minutes) cannot be done without limiting the lengths of one or more songs. It is often desirable to end the slide show with the original end of the background music (rather than simply fading out the song to end the slide show).

Other applications in adjusting a length of a song according to embodiments of the invention include creating a remix of a song (e.g., a DJ may desire certain songs be shortened or lengthened), matching song length to a commercial, a video segment of a movie, or matching a song length or length of plural songs to an event of a known duration (e.g., a presentation of still and/or video images, such as a slide show).

FIG. 1A illustrates the structure of a typical song, including an introduction, several verses having different lyrics, a repeated chorus (which may have the same lyrics), a solo and an end. For certain applications, it is desirable to shorten the song shown in FIG. 1A while maintaining the beginning and end by cutting out an internal section of the song, as shown in the lower portion of FIG. 1A. By automatically detecting optimal splice points within the song (shown as A in FIG. 1A), the song may be easily shortened or lengthened.

Figure 1B:
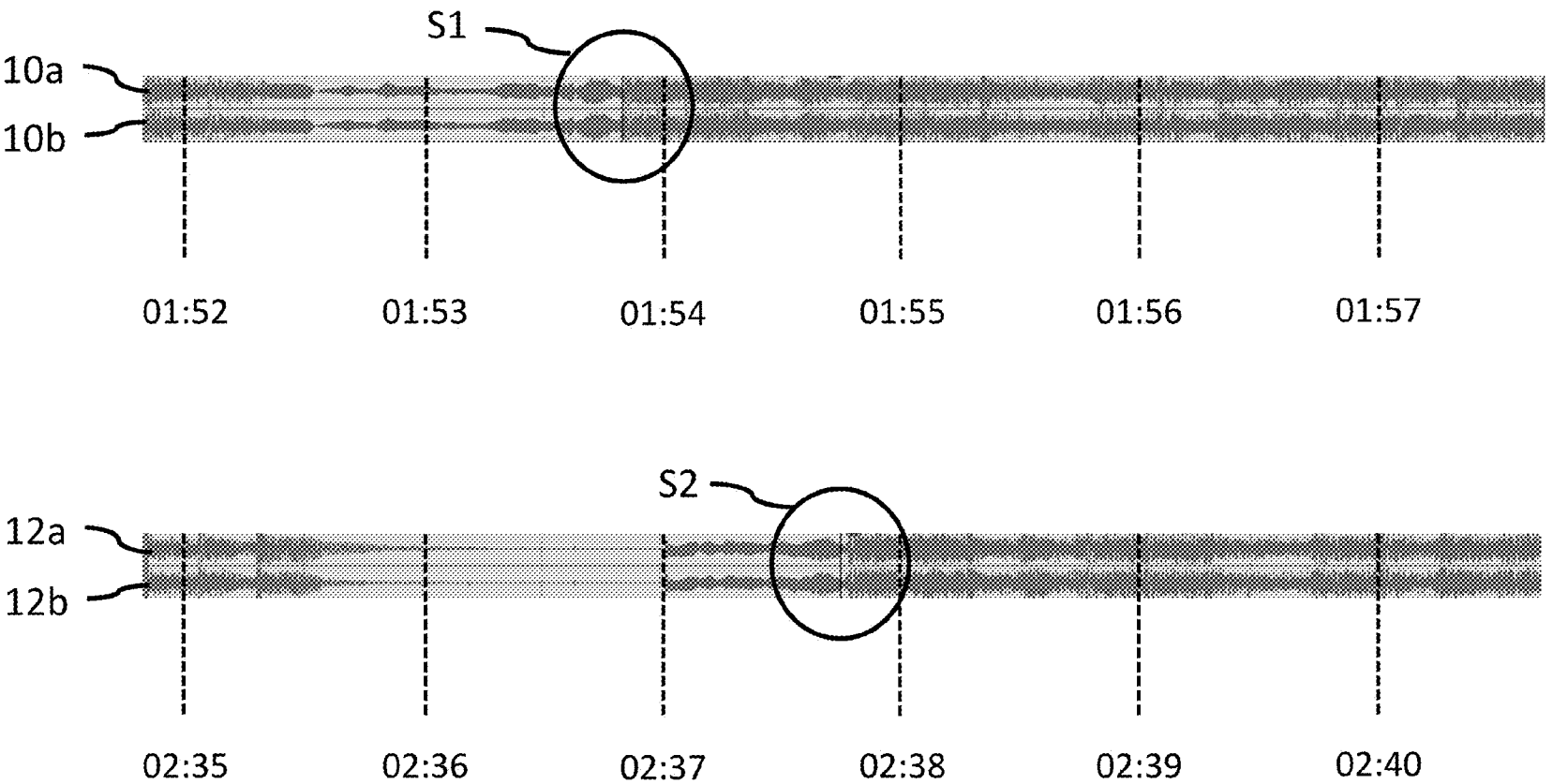
FIG. 1B illustrates waveforms of two portions of the same song.

FIG. 1B illustrates waveforms of two portions of the same song. The first portion, comprising waveforms 10*a* and 10*b*, illustrate a portion of the song from approximately time 1:52 (1 minute and 52 seconds) to time 1:57 (1 minute and 57 seconds), where time notations indicate an elapsed time from the start of the song. Waveforms 10*a* and 10*b* may represent a stereo audio track with 10*a* representing the left channel and waveform 10*b* representing the right channel. The waveform of the second portion of the song comprises waveforms 12*a* and 12*b*, respectively representing the left and right channels from approximately time 2:35 to time 2:40. The example embodiments described herein relate to a stereo audio track, but it should be noted the invention is not limited to two channels—it is also applicable to a mono audio track (with one channel) or more than two channels. Further, it should be emphasized that the described comparisons of the waveforms may be limited to just one channel of a multi-channel audio track (lowering the amount of calculations) or may be performed for plural tracks (increasing the amount of calculations but likely increasing accuracy).

FIG. 1B also highlights segments S1 and S2 of the song at portions slightly before times 1:54 and 2:38, respectively. In this exemplary song, one can identify very similar music and lyrics. The similarity is such that it might be possible for a skilled audio engineer to listen to the song to identify similar portions and study waveforms of these portions to identify matching points in the waveform, and to cut out the parts of the song between the two points of waveform similarity, which shortens the song. For example, the portions of the song between segments S1 and S2 may be cut out so that the song skips the portions between times 01:54 and 02:37. While it may be possible for a skilled audio engineer to perform this task such that the listener cannot detect the splice, such efforts require skill in analyzing the waveform and significant time.

Figure 2:
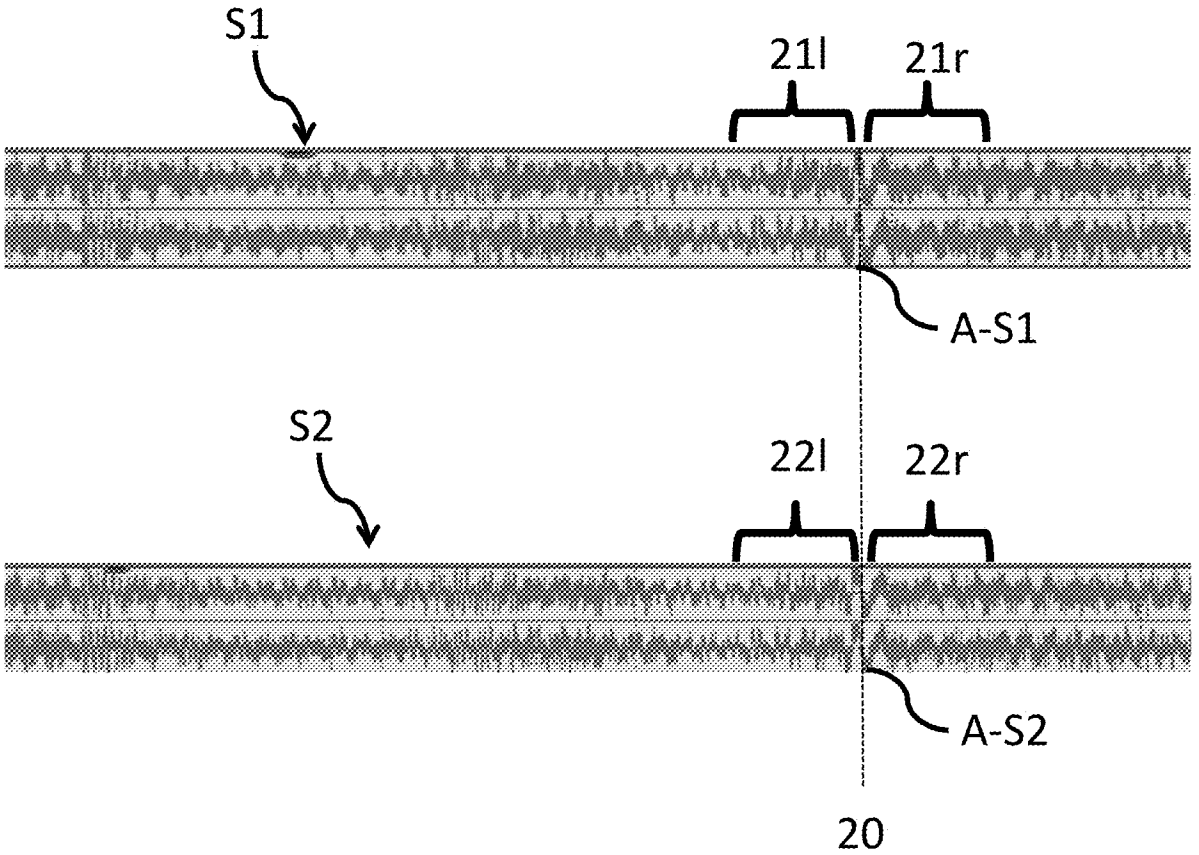
FIG. 2 illustrates further detail of segments S1 and S2 of the waveforms of FIG. 1B.

FIG. 2 illustrates further detail of segments S1 and S2 of the waveforms of FIG. 1B. Dashed line 20 indicates locations within segments S1 and S2 waveforms that are similar. For example, the portions 21*l* and 22*l* of the waveforms S1 and S2 immediately to the left of the dashed line 20 may be very similar (such as being identical). In addition, or in the alternative, portions 21*r* and 22*r* of the waveforms S1 and S2 immediately to the right of the dashed line 20 may be very similar (such as being identical). The dashed line 20 thus identifies a pair of splice points A-S1 and A-S2 in audio segments S1 and S2 that may be used to shorten or lengthen the song with little or no perception to the listener. For example, to shorten the song, portions of the song between A-S1 and A-S2 may be deleted (e.g., in this example, portions approximately between 01:54 and 02:38). To lengthen the song, portions of the song between A-S1 and A-S2 may be repeated upon reaching splice point A-S2 (e.g., during the initial play of the song from A-S1 to A-S2, upon reaching A-S2, the song may skip back to A-S1 and complete the song from this point, repeating the section of the song between A-S1 and A-S2).

Embodiments herein are directed to methods, devices and systems automatically identify two or more portions of a song waveform having sufficient similarity and points within these portions (sometimes referred to herein as "paired splice points" or "grouped splice points") that may be selected to interrupt the original song waveform to delete or insert portions of the song. The embodiments also describe automatically modifying or assisting a user to modify the length of a song using these identified splice points to change the length of the song with little or no audible artifacts evident to the listener. It should be emphasized that many of the embodiments disclosed herein are not mutually exclusive but are useable with one another, in whole or in part—it is impracticable to set forth a separate description to for each possible combination of features of the embodiments described herein, and thus a particular combination of features according to the invention may be described in connection with separate embodiments in this disclosure. Further, devices and systems described herein are contemplated to be configured to perform the methods described herein, and steps of methods may be represented by the portions of this disclosure describing device and system embodiments.

Figure 3:
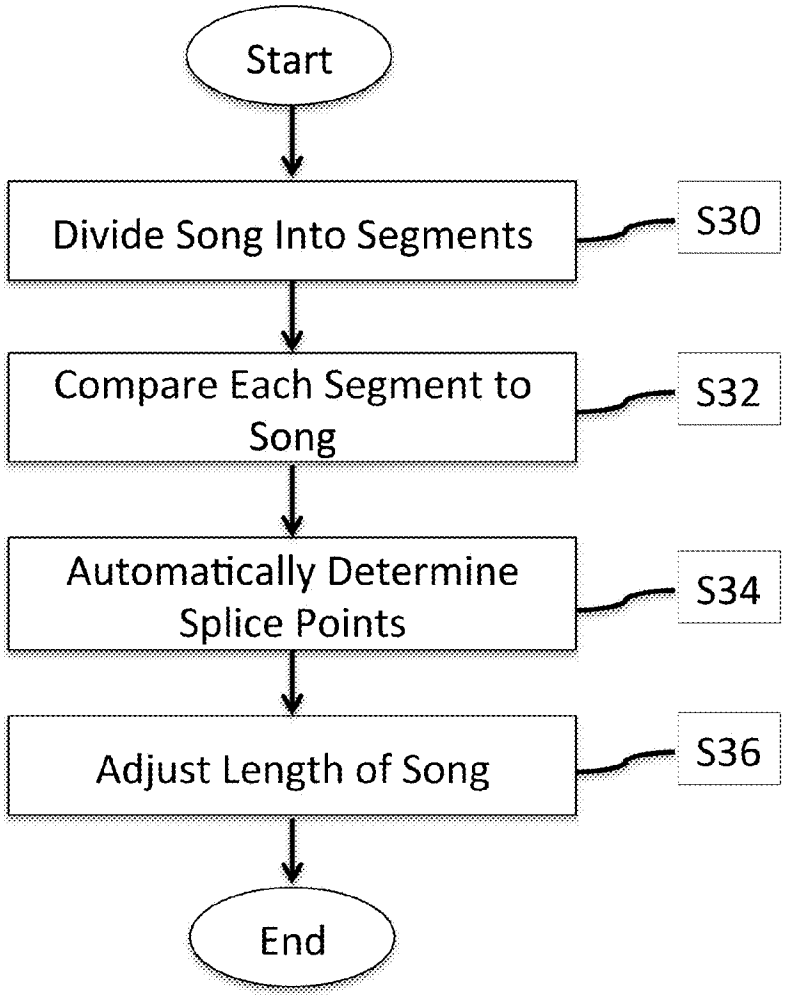
FIG. 3 illustrates an exemplary method of finding similarities in audio segments from different parts of a song.

One exemplary method of finding similarities in audio segments from different parts of a song is shown in FIG. 3. In step S30, the song is divided into multiple segments (referred to herein as audio waveform segments). Then, in step S32, each of these audio waveform segments is compared to the entire song to determine one or more portions of the song that are similar to that audio waveform segment. Step S32's similarity analysis of the audio waveform segment to the entire song may be performed in several different ways. One example of the similarity analysis is cross correlation analysis (exemplary details of this analysis are discussed below). Cross correlation can be viewed as "sliding" the audio waveform segment across the audio waveform of the entire song (or portions thereof, as discussed later). At each location during the slide, a value is obtained representing an amount of overlap of the audio waveform segment and the song waveform, representing a similarity of the waveform. Such similarity analysis may be performed for each of the multiple audio waveform segments of the song to determine other possible pairs or groups of splice points. If previous comparisons of other audio waveform segments to a first location within the song waveform have been performed, it may be unnecessary to perform the comparison of a first segment at the first location with these other audio waveform segments (when part of the entire song waveform).

In step S34, the comparison (e.g., similarity analysis) results are used to automatically determine the existence and location of corresponding splice points within the song waveform. For example, when the audio waveform segment and the song waveform are highly similar, there will be significant overlap and a resulting peak of the cross correlation calculation results will be obtained, corresponding to the location of the overlap of the audio waveform segment and the song waveform. The size of this peak may be used to determine an amount of similarity. If the size of this peak is large enough (e.g., over a certain fixed or calculated threshold) it may be determined that a match exists between the audio waveform segment and the song waveform. When a match exists, the location of this peak in the cross correlation calculation results indicates where the segment and the song match to derive a pair of corresponding "splice points" (sometimes referred to herein as "paired splice points" or "grouped splice points"). The cross correlation calculation results may have multiple peaks that may reveal multiple similarity matches with the audio waveform segment and the portions of the song waveform, and thus the similarity analysis may detect grouped splice points comprising more than two splice points.

In step S36, the song may be shortened or lengthened using the automatically determined splice points. For example, the portion of a song waveform extending between paired splice points (or splice points of the same group) may be removed to shorten the song. Alternatively, the song may be lengthened by (for splice points of the same group) replacing the song waveform occurring after a later splice point with the portion of a song after an earlier splice point (thus repeating a section of the song to the later splice point before playing the song after the later splice point). The modification of the song waveform may be performed by creating a new digital music file (with segments of data corresponding to the song waveform being modified accordingly) or by creating a set of instructions to sequentially play identified portions of the original song. The resulting song of adjusted length may include the same beginning and ending of the original song.

Figure 6A:
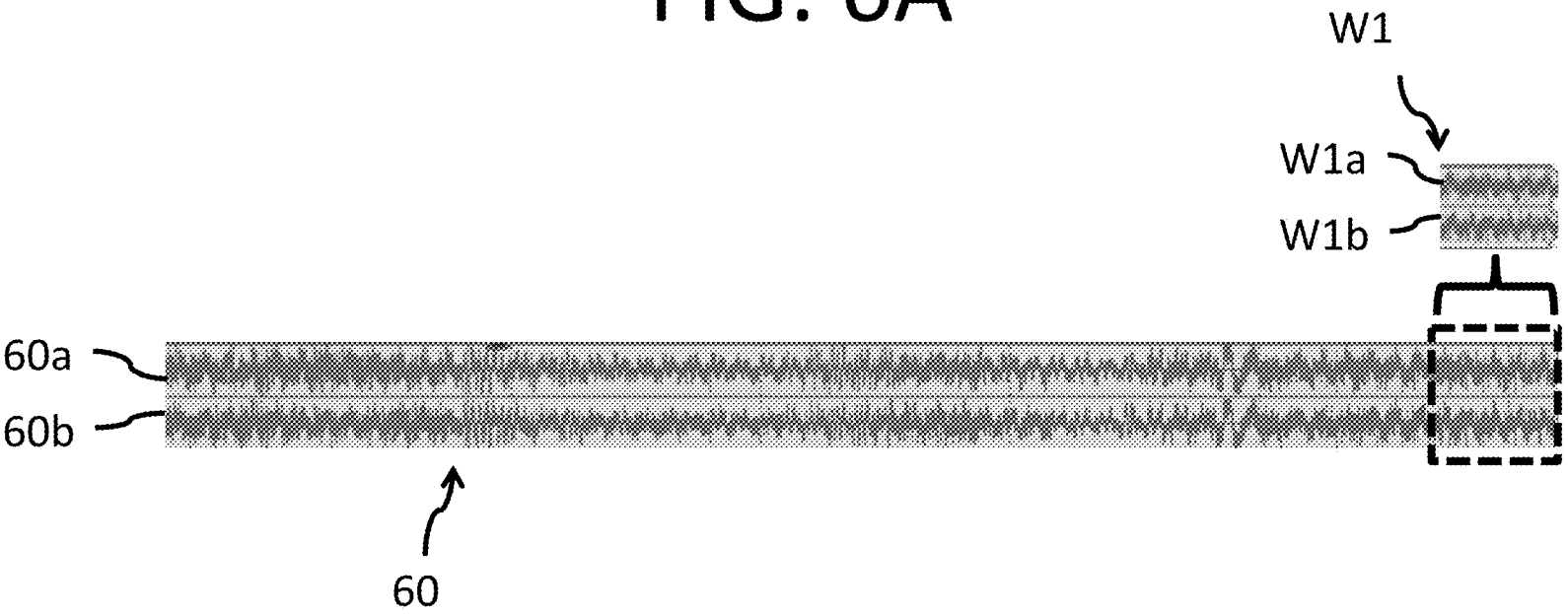
FIGS. 6A, 6B, and 6C illustrate details relating to an exemplary implementation of the method of FIG. 3.

FIGS. 6A-6C and 7A-7C illustrate details relating to an exemplary implementation of the method of FIG. 3. As shown in FIG. 6A, the first step of the process is to extract a segment of audio waveform W1 from the audio waveform of the entire song 60. The audio waveform of the entire song 60 in this example is a stereo audio track and includes portions 60*a* and 60*b* respectively comprising the left and right channels of the stereo audio track. As will be seen, in this example, multiple audio waveform segments are sequentially selected from the end of the song to the beginning of the song, but other orders of segment selection could be implemented, including from the beginning to the end of the song, end or random selection of audio waveform segments of a segmented song waveform. The segment length of audio waveform segment W1 may be within the range of 5-10 seconds long, for example, but may also be less than 5 seconds and more than 10 seconds.

As shown in FIG. 6A, the audio waveform segment W1 includes both left and right channel portions, W1a and W1b. When performing the similarity analyses on both channels, the left channel of the audio waveform segment W1a is compared to the left channel of the song waveform 60*a* and the right channel of the audio waveform segment W1b is compared to the right channel of the song waveform 60*b*. When performing the similarity analyses (such as those described herein) on both channels, grouped splice points may be determined by using the most similar result between the right and left channel comparisons, or by using a summation of the similarity analyses (e.g., cross correlation results) of the left and right channels. Alternatively, the similarity analyses may be performed on just one of the left and right channels to determine grouped splice points.

Next, audio waveform segment W1 is aligned and compared with the portion of the song waveform 60 from where it was extracted (i.e., perform a similarity analysis) to determine how similar W1 is with that same length section of the song waveform 60. As audio waveform segment W1 was extracted from the end of the song waveform with the end of the song, audio waveform segment W1 is initially aligned with the end of the song waveform 60. For this first comparison (in performing a similarity analysis), they are identically similar, since W1 is cut from that section of song.

Figure 6B:
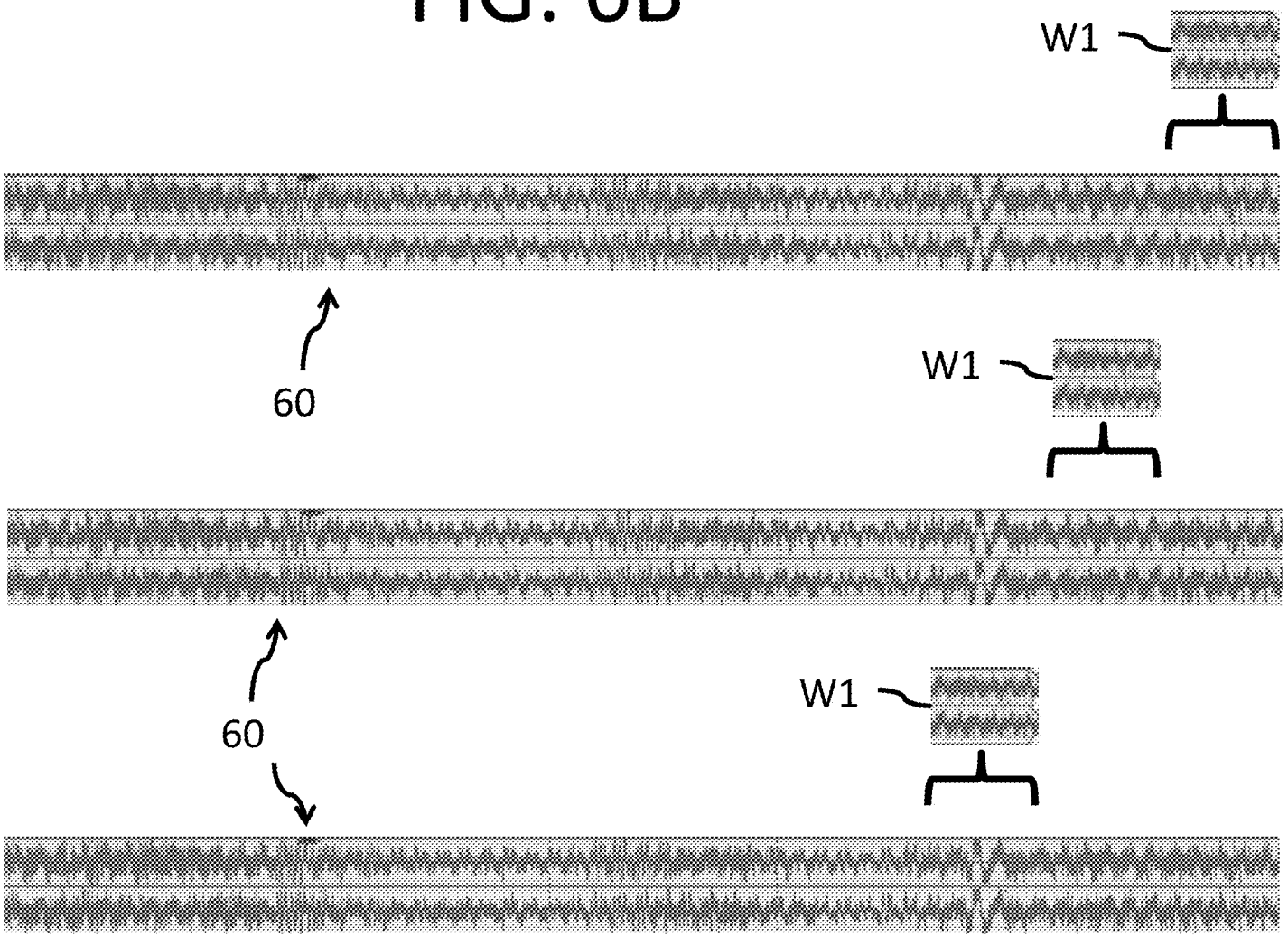

Next, as represented by FIG. 6B, audio waveform segment W1 is slid over the entire song waveform 60, (e.g., from end to beginning or beginning to end) to compare W1 to the song waveform 60 by performing a similarity analysis. For example, to perform the similarity analysis, a cross correlation calculation of audio waveform segment W1 with the song waveform 60 may be performed. This cross correlation calculation may be viewed as sliding W1 across the song waveform 60 to determine plural similarity values between W1 and song waveform 60 as it slides across the song waveform 60.

The cross correlation similarity analysis described with respect to FIGS. 6A and 6B may be performed by the following equation:

$$(F \star g)[n] \stackrel{def}{=} \sum_{m=-\infty}^{\infty} f^*[m]g[n+m].$$

where f and g represent discrete functions of the appropriate channels of audio waveform segment W1 and the song waveform 60 and f* represents the complex conjugate of the function f.

Figures 7A, 7B, 7C:
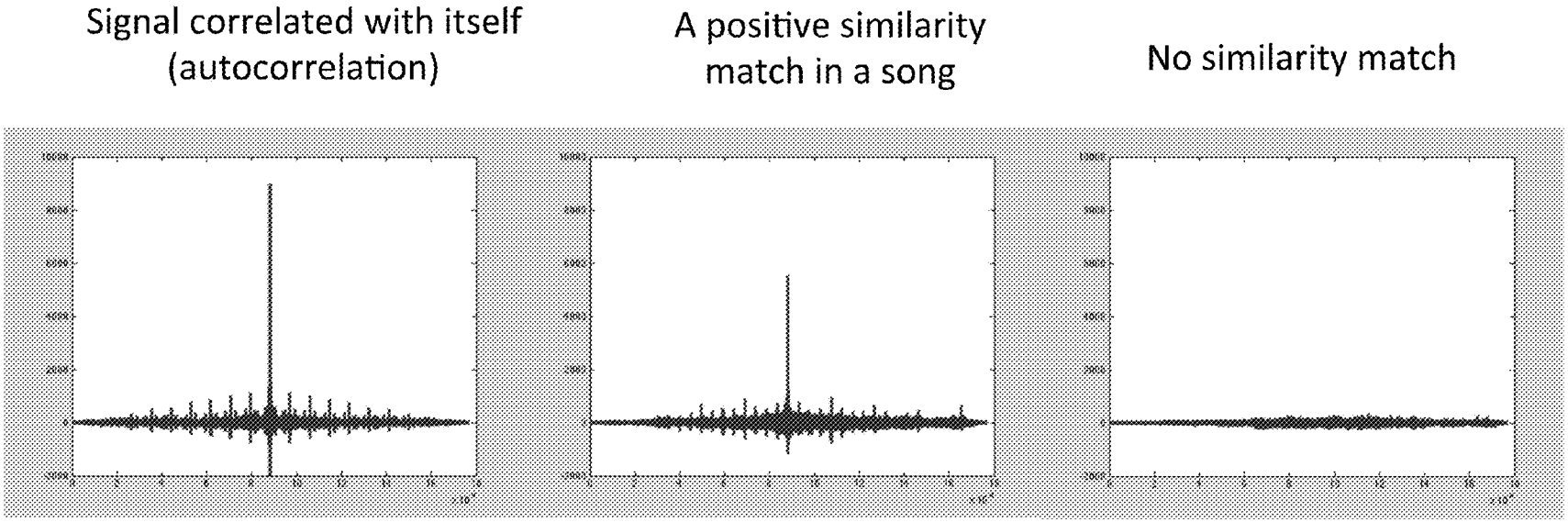
FIGS. 7A, 7B, 7C, 7D and 7E illustrate exemplary the cross correlation calculations results.

As shown in FIGS. 7A, 7B and 7C, the cross correlation calculations may be plotted as a similarity value (y-axis) over location (x-axis, representing the offset between W1 and the portion of the song waveform 60). Although this description refers to this as a "location" it is a location with respect to the graphical representations of the waveforms; locations on the x-axis correspond to time (e.g., time from the beginning of the song).

FIG. 7A illustrates a result of the cross correlation when audio waveform segment W1 is compared to itself (i.e., the portion of the song waveform 60 to which W1 is compared is the portion from where W1 was extracted). FIG. 7B illustrates a result of the cross correlation calculations when W1 exhibits sufficient similarity to a different portion of song waveform 60. FIG. 7C illustrates a result of the cross correlation calculations when no significant similarities exist between W1 and a portion of song waveform 60. Peaks (e.g., above a certain threshold) of the plots of FIGS. 7A and 7B show the audio waveform segment W1 has sufficient similarity and the location of the peak shows the location of that similarity with respect to the audio waveform segment W1 and the song waveform 60. These locations are stored as a first group (or pair) of splice points. If further matches occur in comparing waveform segment W1 to the remainder of the song waveform 60 (e.g., as it is slid across the song waveform 60 for further similarity analyses calculations), these matches may result in further splice points resulting the first group of splice points including more than two splice points, providing further options for splicing the song waveform 60.

Figures 7D, 7E:
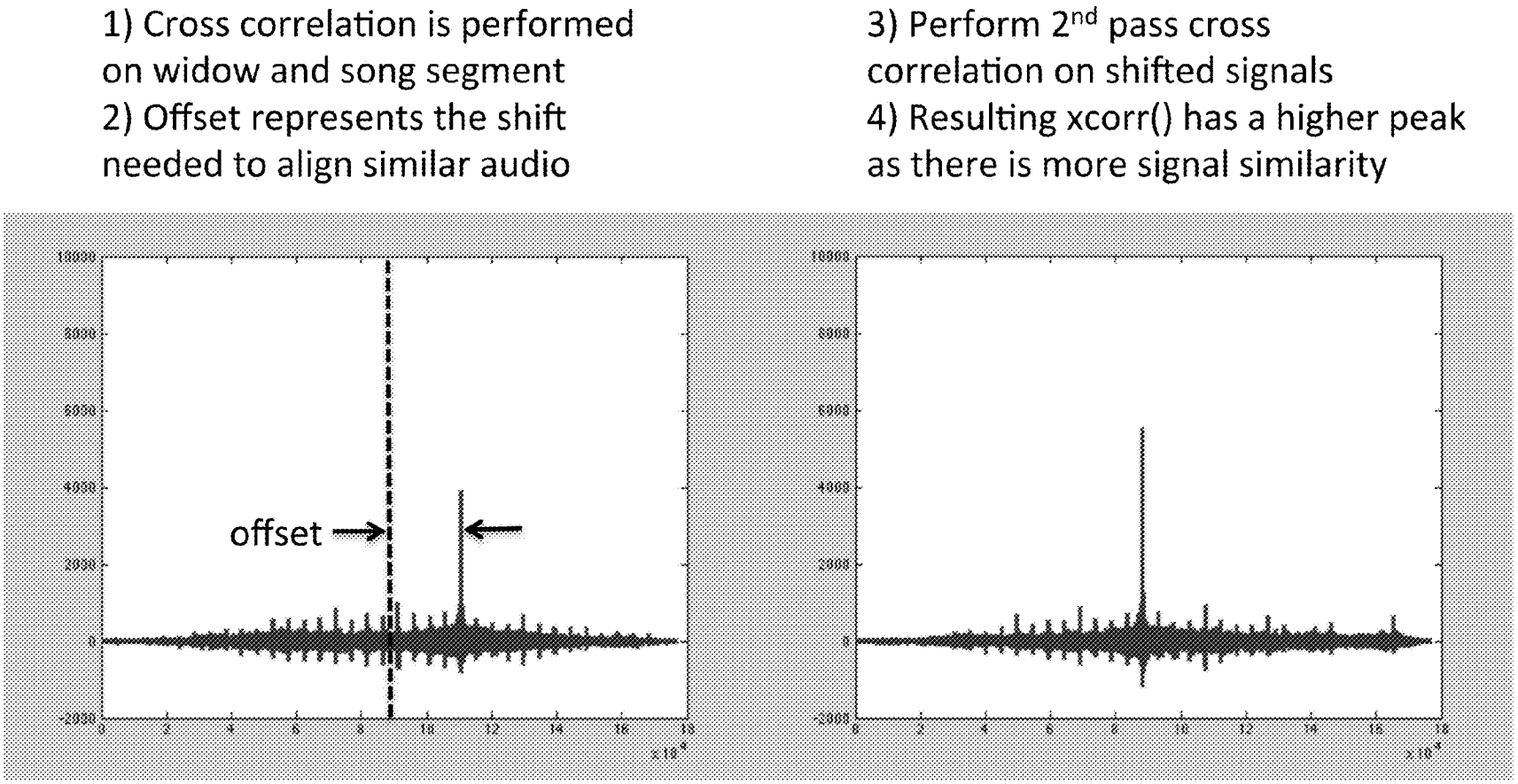
Figure 7G:
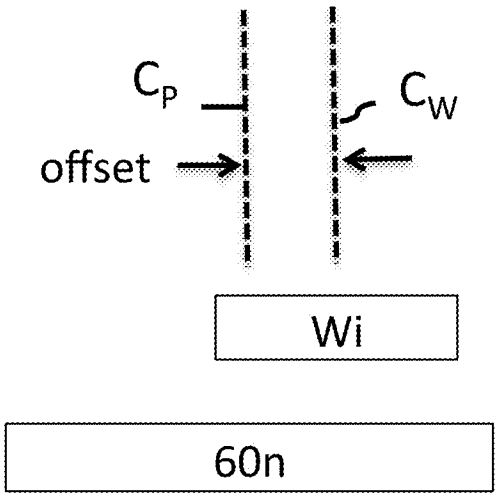
FIG. 7G illustrates an example where the center $C_W$ of an audio waveform segment Wi is offset from the center $C_P$ of a portion of a song waveform 60.
Figure 7F:
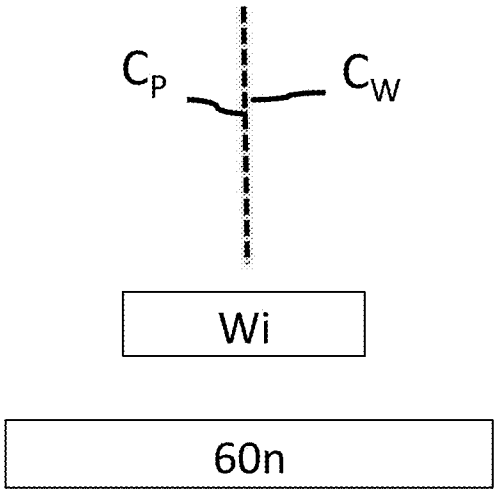
FIG. 7F illustrates an example where the center $C_W$ of an audio waveform segment Wi aligned with the center $C_P$ of a portion of a song waveform.

FIG. 7D illustrates a peak of the result of the cross correlation calculation with an offset (here, an offset from the center of the graphed results). The offset may be used to determine where the audio waveform segment W1 and matches with the song waveform (or with the portion of the song waveform 60). The graphical results of the cross correlation results (e.g., those shown in FIGS. 7A-7E) may represent an amount of overlap between the audio waveform segment W1 and the song waveform 60 as audio waveform segment W1 slides across the song waveform. If each increment in the x-axis of the graphical results corresponds to an increment in the sliding, then a peak in the center of the graphical results indicates a match when the center of audio waveform segment W1 is aligned with the center of the song waveform 60 (or aligned with the center of the portion of the song waveform 60). FIG. 7F illustrates an example where the center $C_W$ of audio waveform segment Wi aligned with the center $C_P$ of the portion 60*n* of song waveform 60. If a similarity match between the waveforms were to occur during cross correlation calculations when the waveforms were aligned as shown in FIG. 7F, the results would show a peak in the center of the graphical results, such as that shown in FIGS. 7A and 7B. FIG. 7G illustrates an example where the center $C_W$ of audio waveform segment Wi is offset from the center $C_P$ of the portion 60*n* of song waveform 60. If a similarity match between the waveforms were to occur during cross correlation calculations when the waveforms were positioned as shown in FIG. 7G, the results would show a peak offset from the center of the graphical results, such as that shown in FIG. 7D. The offset of the peak in the graphical results may thus correspond to the offset in the location of the similarity match of the audio waveform segment Wi to the song waveform portion 60*n*, and thus be used to determine the location of the similarity match between the same.

FIG. 7E illustrates an example where after cross correlation calculation results in an offset as shown in FIG. 7D, segments of the waveforms are chosen to remove the offset, and the cross correlation calculations are repeated. As can be seen by comparison of FIGS. 7D and 7E, the magnitude of the peak has increased, which may be attributable to more of the waveforms matching.

The results of the initial comparison of waveform segment W1 with itself as embedded in the song waveform 60 (exemplified by FIG. 7A) may be used to provide a baseline for determining whether results of subsequent comparisons are significant enough to constitute a match. For example, the threshold for determining a match (to which a peak in the cross correlation calculations is compared) may be set as a percentage of the magnitude of the peak of the initial comparison. For example, a match (and a resulting pair of splice points) may be detected if a peak in later cross correlation calculations involving W1 has a magnitude greater than 30%, greater than 50% or greater than 70% of the magnitude of the peak resulting from this initial comparison (exemplified by FIG. 7A). Later audio waveform segments Wi extracted from the song waveform 60 may use the results of their initial comparison with themselves as embedded in the song waveform 60 in a similar manner.

Figure 6C:
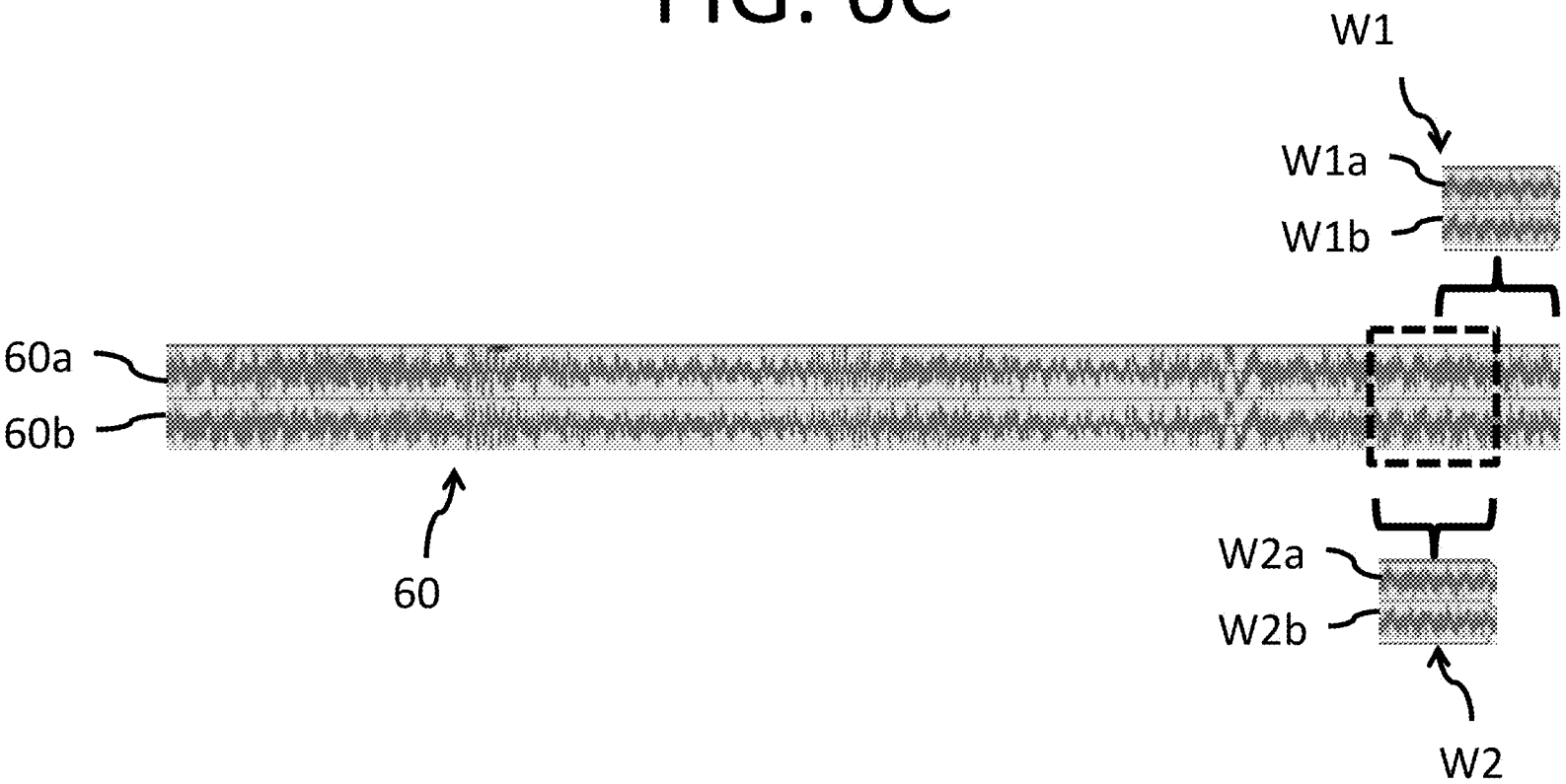

As shown in FIG. 6C, once the window, W1, has been slid across the entire song to compare audio waveform segment W1 to the song waveform 60, a second audio waveform segment W2 is extracted from the song waveform 60. Here, the second audio waveform segment W2 is an audio window of the song waveform 60 that is shifted to the left of W1 by some number of samples of the song waveform. A shift of one half of the size of the windows W may be used, as shown in FIG. 6C. Then, the audio waveform segment W2 is compared to the song waveform 60 in the same manner as described with respect to audio waveform segment W1. The resulting similarity analysis (e.g., cross correlation calculations) with respect to W2 and song waveform 60 is analyzed to determine the existence of a second group of splice points (to thereby provide options for splicing the song waveform 60 between these grouped splice points). Remaining audio waveform segments W3 to Wn may be similarly compared to the song waveform 60 so that all segments of the song may be compared to the song to determine splice points.

Splice points may be determined by analyzing peaks resulting from the comparison of the audio waveform segments Wi to the song waveform 60. In some embodiments, the splice points are selected as those corresponding to the highest peak magnitudes (e.g., the top 20) of all resulting peaks of all audio waveform segment comparisons (here, of all peaks resulting from the comparisons of audio waveform segments W1 to Wn to the song waveform 60). Alternatively, the splice points are selected, for each audio waveform segment comparison (e.g., cross correlation calculation) as those corresponding to the highest peaks resulting from that comparison. Other selection criteria may be employed, such as selection criteria based on quality analysis (e.g., peak comparison) as well as to provide a variety of song versions of different lengths (e.g., if a large group (e.g., 10 or 20) high quality splice point pairs result in a similar song length (or resulting in the same portion of the song being spliced), a lower quality splice point pair may be selected to replace one of higher quality splice point pairs.

Figure 6D:
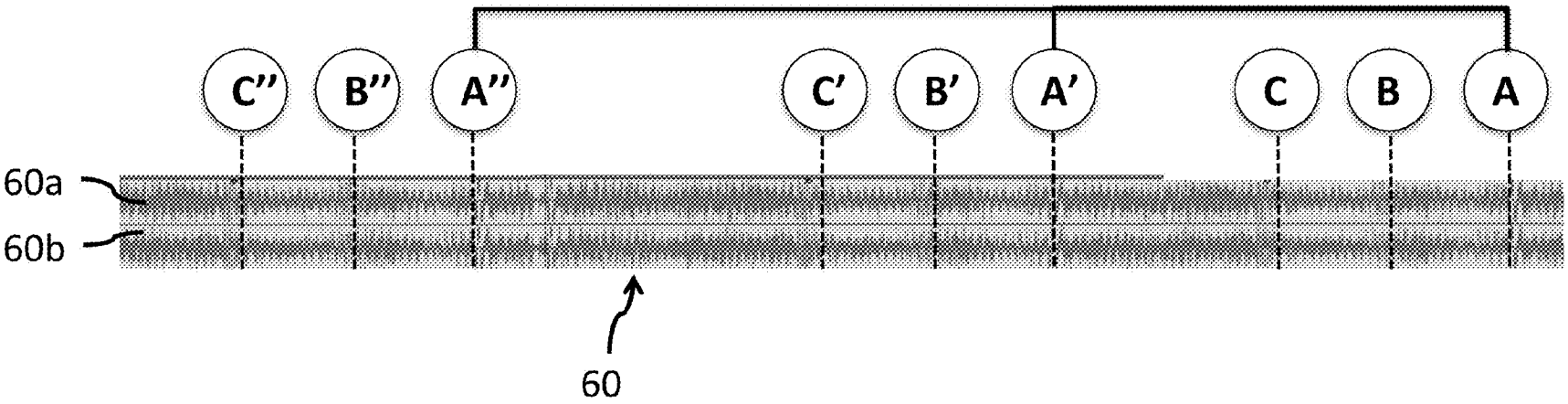
FIG. 6D illustrates an identification of three groups of splice points.

Note different groups of splice points provide different options for splicing the song waveform 60—i.e., interrupting the original song waveform at a splice point of the nth group, should be followed by the original song starting at another splice point of the same nth group. In the example shown in FIG. 6D, three groups of splice points have been identified: a first group of splice points A, a second group of splice points B and a third group of splice points C. In FIG. 6D, the song may be shortened by removing portions of the song between any two splice points of a group (i.e., between any "A" splice points, between any "B" splice points or between any "C" splice points). The song may be lengthened by repeating a portion of the song between any two splice points of a group. For example, to shorten the song, portions of the song waveform between any two of splice points A may be eliminated. Similarly, portions of the song waveform between any two of splice points B or between any two of splice points C may be eliminated to shorten the song. To lengthen the song, after a later splice point A, the song starting from an earlier splice point A may be added. Similar lengthening may be done with two of splice points B or two of splice points C. Thus, the song length may be altered while still maintaining its original beginning and end. As will be appreciated, the pair of splice points selected for splicing the song may affect the how much the song is lengthened or shortened. Such selection may be performed automatically (which may be automatic and may also be responsive to user input, such as a desired length of the song, a desired length of a slide show, etc.) or may be performed by the user (such as by letting the user drag graphical representations of the splice points to each other). Further details of such example embodiments are described below.

Other sequences of similarity analyses than that described above may be performed between audio waveform segments Wi and the song waveform 60. For example, extraction of the audio waveform segments may start from the beginning of the song. As another example, cross correlation calculations may start with a comparison with a portion of the beginning of the song. It may be desirable that after all audio segments Wi have been extracted, that all segments have been compared with each other, whether as an extracted audio waveform segment Wi or embedded as part of the song waveform 60. It may be unnecessary that later extracted audio waveform segments be compared to the entire song waveform 60. For example, it is unnecessary to perform a cross correlation of audio waveform segment W2 starting at the end of the song waveform 60 as this comparison was previously made when audio waveform segment W1 was compared to the portion of song waveform 60 including W2 (the portion from which audio waveform W2 was extracted).

As discussed, after determining a match between an audio waveform segment Wi and a corresponding portion of the song waveform 60, splice points are associated with each other to form grouped splice points (and may form plural groups of splice points) to provide options for altering the length of the song. The exact location of the splice points within the audio waveform segment Wi and the corresponding portion of the song waveform 60 may be selected in many ways. One way is to simply choose the earliest time location of the audio waveform segment Wi and a corresponding matching point of the song waveform 60 (aligned to the audio waveform segment Wi as determined by the offset of the peak resulting from the cross correlation calculations). Pyramid processing may be performed to compare subdivided portions of the audio waveform to the corresponding portions of the song waveform 60. If only some of these subdivided portions are shown to match, the splice point pair may be adjusted so that they start at or fall within matching portions of the audio waveform segment Wi and the song waveform 60. Pyramid processing is described further below.

The songs that may be used with this method are often represented by digitally sampled waveforms. The music may be captured at a defined sample rate—44,100 samples per second is one popular sampling rate. As noted, the audio waveform segments (e.g., W1) may be slid across the entire song waveform 60 to compare audio waveform segment to the song waveform 60. When the song waveform 60 is represented in digital format, the sliding of the audio waveform segment may be performed with a step size of one sample, and perform a similarity analysis at each of these step (separated by a sample width). This may be computationally very expensive. One way to reduce calculations is to perform similarity analysis between decimated versions of the audio waveform segments Wi and the song waveform 60 (keeping every Mth sample), or otherwise using only every Mth sample of the audio waveform segments Wi and the song waveform 60 in comparing the waveforms. M may be an integer between 5 and 10, e.g.

In another example, rather than compare an audio waveform segment W to the entire song waveform 60 in one calculation, each audio waveform segment W may be "stepped" across the song waveform 60 for comparison to only a portion of the song waveform 60 at a time. Each portion of the song waveform 60 is then compared to an audio waveform segment W in a separate cross correlation calculation, which may reduce the complexity of each of these cross correlation calculations (e.g., for each audio waveform segment Wi, a cross correlation calculation may be performed for each of the multiple portions of the song waveform 60). The step size (or size of the portions of divided song waveform 60) may be equal to or more than 2 times the size of Wi or equal to or less than 5 times the size of W1. One could create step sizes that are larger—perhaps one or two seconds, or even the same size as the sample waveform, Wi. For example, one may use a step size that is one half the width of the sample window (the audio waveform segment), Wi. When these portions of the song waveform 60 and audio waveform segments Wi are at least five seconds in length, it has been found that similarity analyses results produce splice points that better reflect similarities at a chorus or refrain level of the song, making length changes to the song less detectable. Splice points that better reflect similarities at a chorus or refrain level of the song may be better discriminated by when at least one of the portions of the song waveform 60 and the audio waveform segments Wi is 10 seconds or more and the other is at least 5 seconds or more. When the audio waveform segment Wi and the these portions of the song waveform 60 are smaller (e.g., less than two second in length), similarity analyses may create splice point pairs that result from similarities in background music, which may be less desirable splice point pairs. Thus, it may be desirable in some implementations to keep the size of the audio waveform segment Wi and the portions of the song waveform 60 greater than 2 seconds.

Other sequences of similarity analyses may be performed between audio waveform segments Wi and the song waveform 60. It is desirable that after all audio segments Wi have been extracted, that all segments have been compared with each other, whether as an extracted audio waveform segment W or embedded as part of the song waveform 60.

In the examples discussed herein, cross correlation is used in performing the similarity analyses of the audio waveform segment Wi and the song waveform 60. The cross-correlation of two vectors may be the product of their respective Fourier transforms, with one of the transforms conjugated. However, alternative embodiments contemplate other ways to measure the similarity between an audio segment and the song, ranging from time-domain methods, such as subtracting samples between Wi and the song waveform to find minimum measure, to performing frequency domain analysis using Fourier methods to find similar signal matches. The system and software for adjusting song length may implement various methods of similarity analysis such as time domain/cross correlation methods and/or frequency domain/Fourier analysis.

Figure 8:
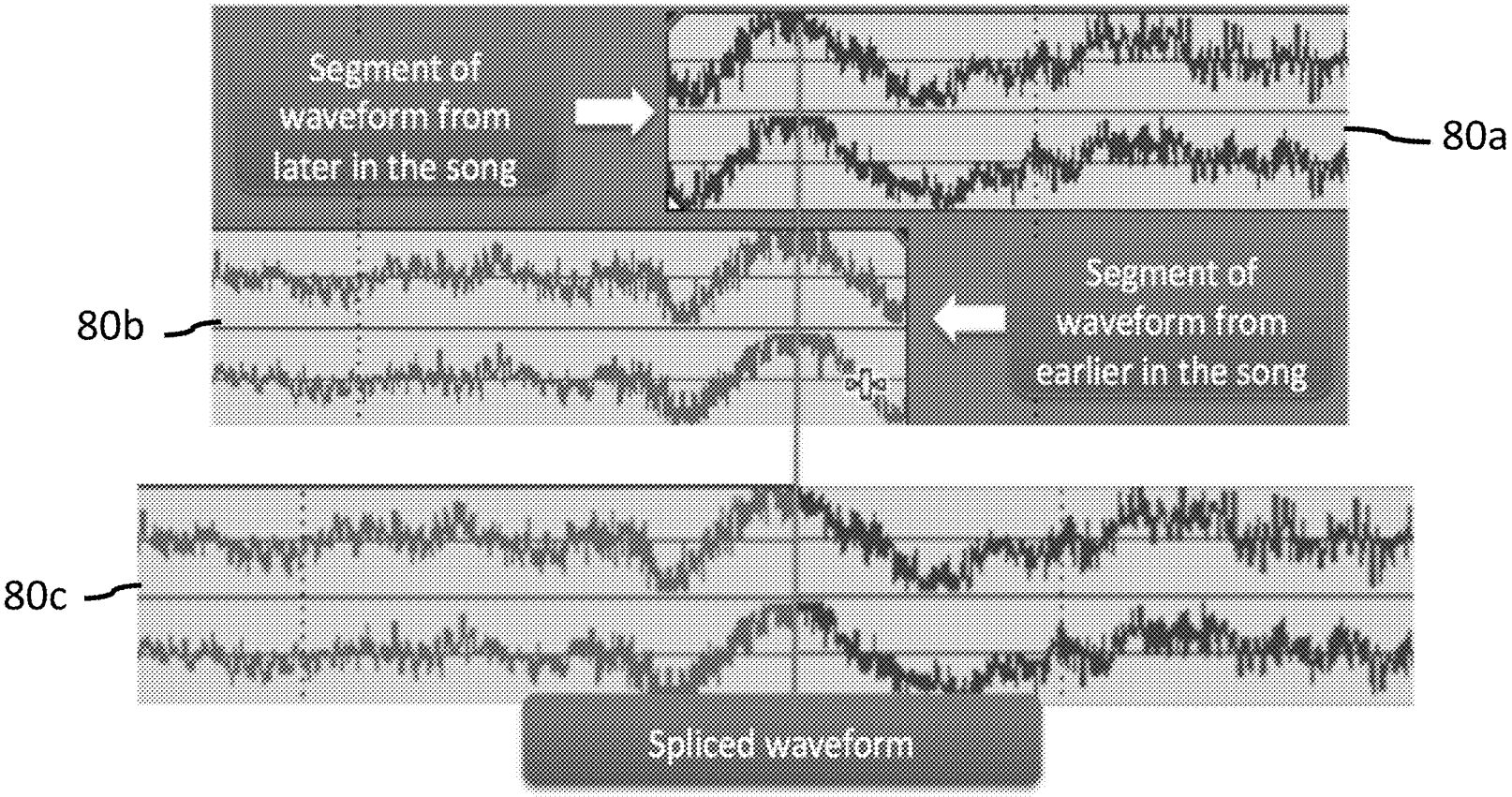

Once point(s) of similarity have been identified and designated as optional splice points, the software may then splice the song, to make it shorter (or longer, as desired). FIG. 8 illustrates two parts of the song waveform that are similar. The song may be cut at the splice points, and then concatenated to join the left portion of waveform 80*b* to the right portion of waveform 80*a* at the splice points. The resulting song waveform 80*c* is shorter than the original.

To make the song longer, rather than splice out a portion of the song, a portion of the song may be repeated. For example, rather than deleting a portion of the song between two identified splice points, we may add the song at the earlier splice point to the song at the later splice point, thereby repeating the section between the two splice points. This may be done one or more times to repeat the section one or more times. In this example, the song may remain unchanged at portions corresponding to the identified splice point locations for certain portions of the resulting song.

Figure 9A:
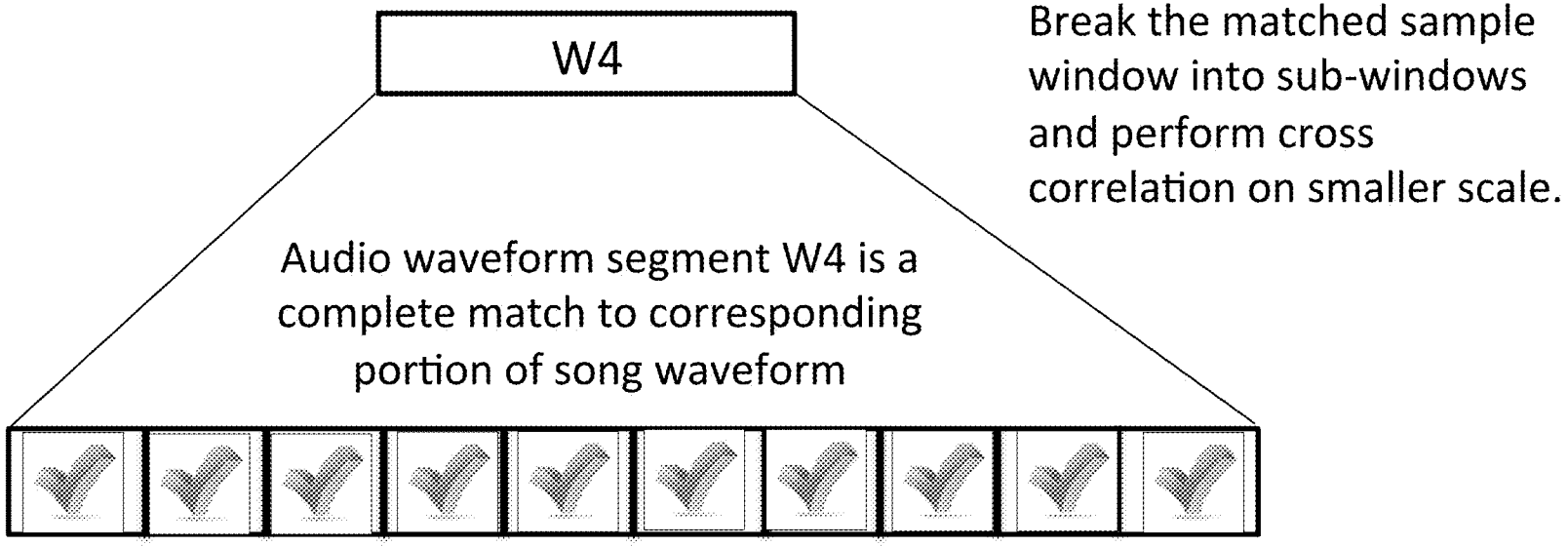
FIGS. 9A, 9B and 9C illustrate details regarding exemplary pyramid processing embodiments.
Figure 9B:
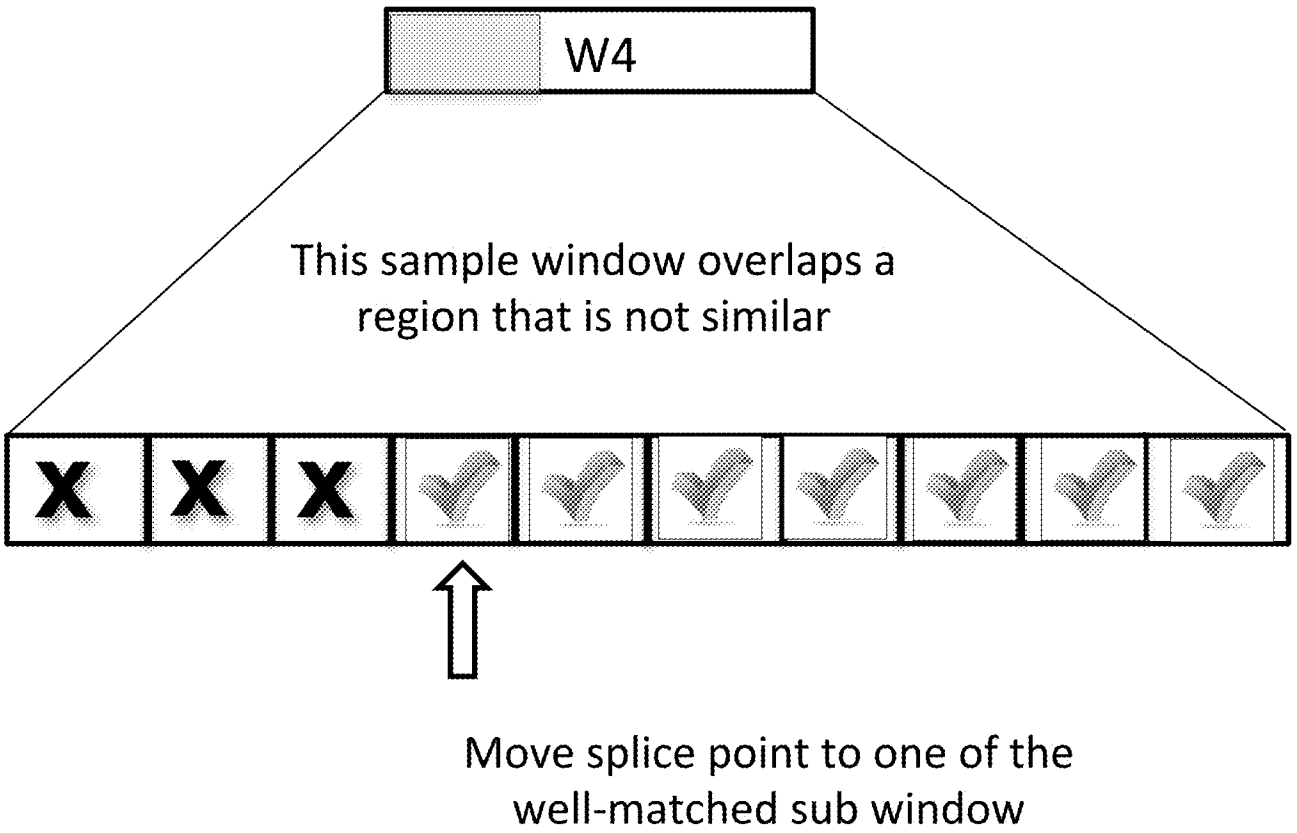

A successful cross correlation match may not guarantee that the waveform will be sufficiently similar across the entire audio waveform segment Wi. For example, if two thirds of the audio waveform segment Wi match the song waveform 60, a match may be detected between Wi and a portion of song waveform 60, even if a third of the audio waveform Wi and the corresponding portion of the song waveform 60 do not match. Using resulting splice points for splicing the original song might produce an undesirable result. Additional processing may be done to adjust the splice point to a point in the audio that is sufficiently similar. One method is to perform pyramid processing. For example, after detecting a match in the initial similarity analysis between segment Wi and the song waveform 60, the audio waveform segment Wi may be subdivided into smaller segments and similarity calculations may be performed on each of these sub-segments. Referring to FIGS. 9A and 9B, assume an initial cross correlation analysis indicates the audio waveform segment of window W4 is substantially similar to the audio waveform segment of portion P3 of the song. Audio waveform segment in window W4 may be subdivided, and each of these subdivided segments may be compared (via a similarity analysis) to the portion P3, such as by performing a cross correlation analysis of each of the subdivided segments of W4 to portion P3. In FIG. 9A, each of the sub-segments matches, so the splice point can remain as previously calculated.

In FIG. 9B represents a situation where the audio waveform segment W4 is not similar across the entire waveform with the corresponding portion of the song waveform 60, even though it produced a similarity match based on the initial similarity analysis (e.g., cross correlation calculation). In this case, after analyzing the similarity at a finer granularity, the pair of splice points may be moved to locations where the audio waveform segment W4 and the portion of the corresponding waveform 60 are more similarly matched. For example, after the initial similarity analyses, if the initial splice point pair was selected as the earliest time of audio waveform segment W4 and the corresponding portion of the waveform 60, the splice point pair may be shifted over by three sub-segments to locations of these waveforms that are more similar.

Figure 9C:
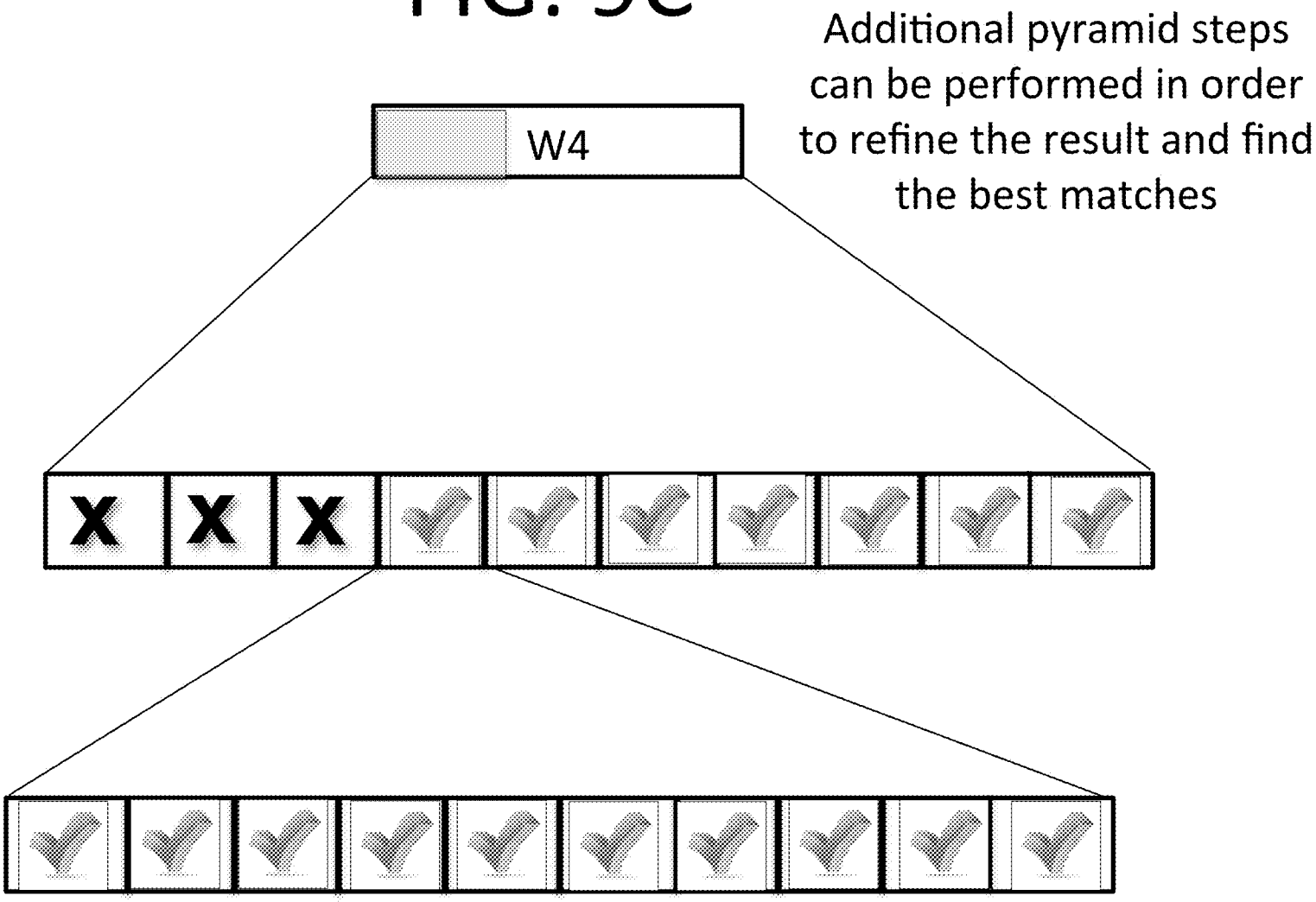

FIG. 9C illustrates a further alternative where pyramid processing (such as described with FIG. 9B) is performed by further subdividing a previously subdivided portion of the audio waveform segment. In this example, the additional pyramid processing is performed on the initial subdivided portion of audio waveform segment W4 that is closest to the non-matching subdivided portions of the audio waveform segment W4 (e.g., the subdivided portion of W4 fourth from the left in FIG. 9C).

Even more processing may be performed to find the most precise match that is possible. As shown in FIG. 10, one method to do fine matching is to take the first and second derivatives of the audio waveform segment W4 and the related portion of the song waveform 60, which can reveal fine matches at signal peaks or zero crossings, which may be selected as a splice point pair or as splice points for a group of splice points. For example a zero crossing (from positive to negative) in both the audio waveform segment W4 and the related portion of the song waveform 60 (that are properly aligned based on the cross correlation peak offset) may be selected as a splice point pair. Such fine matching may be performed after determining to use splice points associated with a splice point pair. For example, a rough estimate of a splice point pair may be provided by an initial cross correlation calculation, and after selection of the splice point pair for splicing the song, the fine matching may be used to adjust the location of the splice point pair to correspond to a zero crossing, or peak of the waveforms.

There are a number of ways to determine how to modify the length of the songs based on the automatically detected splice points. The embodiments below describe shortening one or more songs, but they are equally applicable to lengthening one or more songs (or a mixture of lengthening one or more songs and lengthening one or more songs). The shortened songs may be spliced from the original song while maintaining the beginning and end of the original song. In one embodiment, song lengths are shortened (e.g., automatically without being based on input from a particular user) to a length typically desirable for use in a slide show. For example, the original song may be shortened by one to two minutes, more than two minutes, or to one or more versions that have lengths that fall within a range of 40 seconds to 90 seconds, or that are less than 75% of the original length or are less than 50% of the original length. These shortened songs may include the beginning and end of the original song. A user may be presented with a list of the songs and their time to select songs. The shortened songs may be added as background music to a slide show or other audio visual presentation.

In another example, the user may submit a song for shortening utilizing one of the embodiments described herein. The user may receive a shortened song that is determined to provide the least ability to detect a splice of the original song, e.g., based on similarity analysis described herein. Such similarity analysis of various splice options may review peaks resulting from previously cross correlation calculations and select splice points corresponding to the maximum peak. Alternatively, the splice points may be chosen based upon clustering of splice points, indicating a significant length of similarity within the song.

In another example, the user may submit a song for shortening utilizing one of the embodiments described herein. The initial shortened song may be selected from paired splice points that result in a shortened song having the least time removed (as compared to other options for song shortening using the groups of splice points). The user may hit a button (or otherwise request) a next shorter song, resulting in a shortened song of the next shortest length among the options for a shortened song. Alternatively, the user may first be presented with the shortest shortened song and each subsequent request may result in the next shortest song (e.g, after the shortest song, the user may receive the second shortest shortened song among the options for a shortened song based on the determined splice points).

Alternatively, the user may be shown a song waveform with the groups of splice points indicated by labeled ("splice handles"). For example, the splice handles may be similar to those represented in FIG. 6D (splice points visually identified on a display with 'A', 'B', etc.). Corresponding splice points might be color coded as well. The user may then select the portion of the song to be deleted between two matching splice handles. Via a user interface (e.g., a display and an input device, such as a mouse, touch pad or touch screen) a user may drag one splice handle to a second matching splice handle to delete the portion of the song between these two splice handles (e.g., using a mouse or track pad to click on and drag a first splice handle A to a second splice handle A" provides instructions to shorten the song to delete portions between these splice handles). To assist the user, the words of the song may be provided below the song waveform (or otherwise associate the words of the song with the waveform, other timeline or other visualization of the length of the song—such as pop-up balloons with text resulting from scrolling over the song waveform) so that the user may choose to keep more meaningful lyrics or delete more repetitive lyrics.

In a further example, independently calculated splice point pairs of a song are analyzed for their similarity in differences in time in the song. The method "clusters" valid splice points (or clusters splice points determined to have sufficient quality). For example, adjacent splice points that have similar splice features may be clustered or grouped into a single splice object. Users can then interact with that single splice object rather than a single splice point. The splice object may be used equivalently to a splice point of a splice point pair, and be selected with a corresponding splice point object to shorten or lengthen a song. As part of clustering, a single one of the splice points of a clustered spliced object may be provided to a user and/or used in a splicing the song in a manner described herein.

Figure 12:
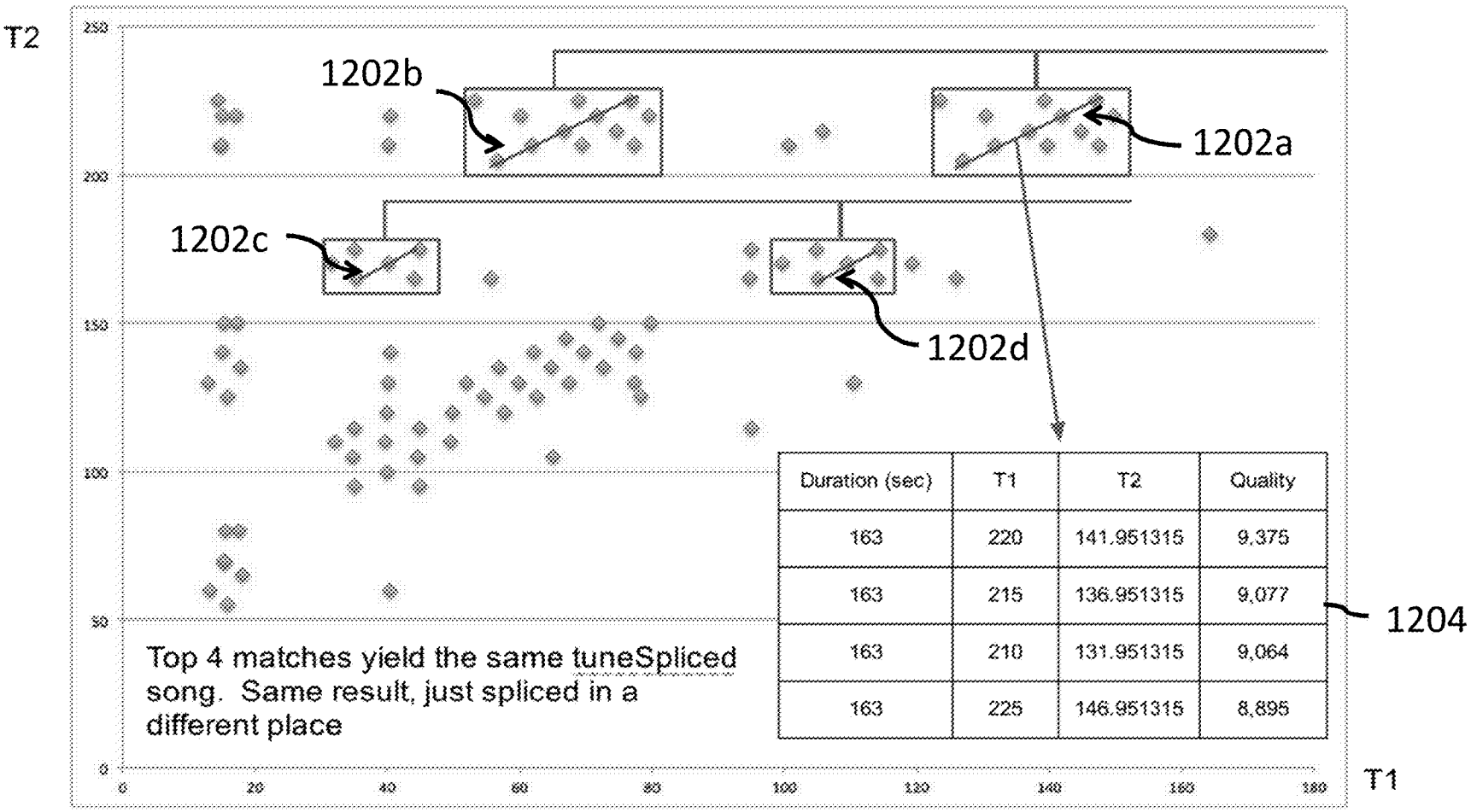
FIG. 12 illustrates calculated valid splice points plotted on a graph.

Clustering of similar splice points becomes apparent when valid (possible) splice point pairs are mapped. Valid splice point pairs refer to splice point pairs determined to meet some quality criteria (e.g., due to evaluation of a comparison of a segment to a remaining portion of a song, as discussed elsewhere herein). The graph of FIG. 12 shows all valid splice points calculated for a particular song. Each valid splice point pair is plotted on the graph of FIG. 12 with the x-axis (horizontal) representing a time T1 of a first point the splice point pair and the y-axis (vertical) representing a time T2 of the second splice point pair.

FIG. 12 illustrates patterns in plotting of the valid splice point pairs. Specifically, as illustrated by splice point pair clusters 1202*a*, 1202*b*, 1202*c* and 1202*d*, certain valid splice point pairs adjacent to each other on the graph have little or no difference in time between them. Looking at the Table 1204 in FIG. 12 illustrates the values T1 and T2 for the splice point pairs of splice point pair cluster 1202*a*. Each splice point pair comprising a first time value (T1 in the song) and a second time value (T2 in the song) (the time values T1 and T2 may represent a time elapsed from the beginning of the song to the relevant splice point). T1 values are separated by exactly five seconds. This five second value corresponds to a predetermined shift (or step value) of five seconds from one window Wn of an audio waveform segment to the next window Wn+1 (when comparing the audio waveform segments to the song waveform 60 as discussed elsewhere herein). T2 values also differ from each other by 5 seconds. The specific T2 value is determined from comparison of the audio waveform (having time T1) to the song waveform (e.g., the cross correlation offset). Valid splice point pairs with adjacent T1 values (here, every 5 seconds) have corresponding T2 values, each T2 value having the same or very little difference in time with their corresponding T1 splice point. This same or little difference for groups of adjacent T1 values (or T2 values) acts as a "fingerprint" for identifying a matching splice point cluster. In this case, we see that for each splice point pair, T2 is 78.04869 seconds from its corresponding T1 splice point of the pair (220−141.959315=78.04869−the first splice point pair in table 1204 has a first splice point at time 220 (T1) and a second splice point pair at time 141.959315 (T2)). Note that 1.959315 seconds is an offset value from a cross correlation calculation and may also be used as a "fingerprint" for identifying a matching splice point cluster. When xcorr( ) results from time adjacent steps (e.g., adjacent windows Wn and Wn+1) yield an offset that is equal to 10E-6 places (i.e., to a millionth of a second), that indicates that the adjacent splice matches are part of a larger similar waveform and those splices can be grouped. Equality to 10E-6 is not necessary but helpful for explanation to show portions of the song align in a same fashion. Splice point clusters may be determined with lesser similarities, such as equal to 10E-3 places (e.g., equal to a thousandth of a second) or to 10E-2 places (e.g., equal to a hundredth of a second).

Figure 6E:
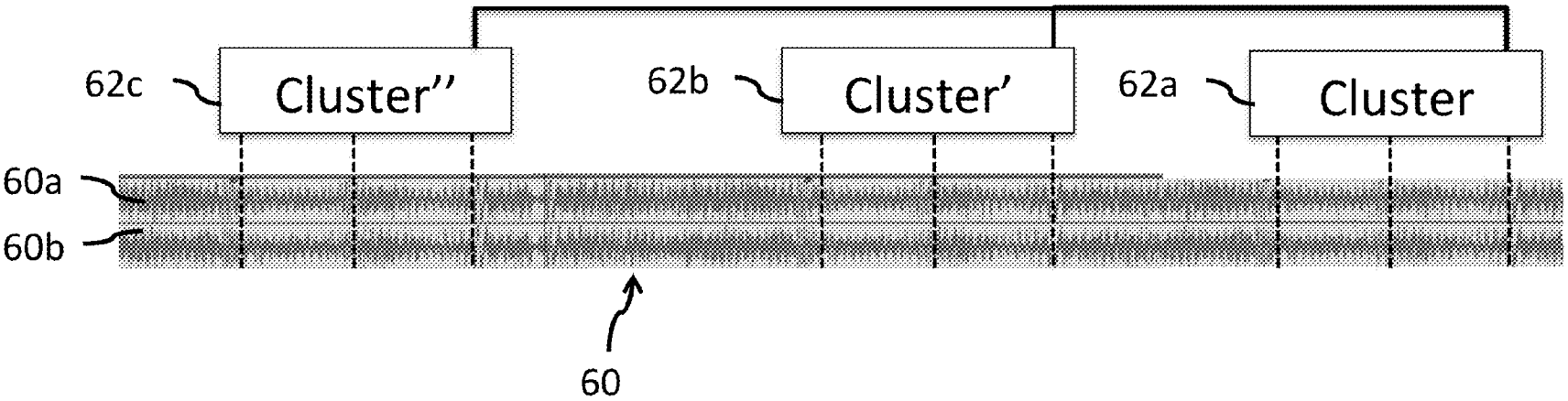
FIG. 6E illustrates adjacent splice points consolidated into a clustered slice object.

As shown in FIG. 6D, we see three sections of a song that have matches at three different splice point groups (splice group A, splice group B and splice group C). By performing splice point clustering, the adjacent splice points (e.g., A, B and C) can be consolidated into a clustered splice object. As shown in FIG. 6E, adjacent splice points A, B and C have been consolidated into a clustered slice object 62*a*, adjacent splice points A', B' and C' have been consolidated into a clustered slice object 62*b* and adjacent splice points A", B" and C" have been consolidated into a clustered slice object 62*c*

In one version of splice point clustering, the user can manipulate clustered splices (e.g., one of 62*a*, 62*b* or 62*c* in FIG. 6E) to drag grouped splice points (the clustered splices) to a neighboring group to shorten a song. For example, via a user interface displaying the graphics of FIG. 6E, a user may manipulate a cursor (e.g., via a mouse or track pad) and click and drag 62*a* to 62*c* to eliminate a portion of the song between two splice point pairs of 62*a* and 62*c* (e.g., A and A").

In another version, the user is presented with a list of pairs of clustered splices points, selection of a pair of clustered splice points resulting in splicing of the song using one of the pairs of splice points (e.g., A and A" in FIG. 6D) forming respective elements of the clustered splices. This version provides the user with fewer redundant splices to evaluate (only one option would be provided for clustered splices 62*a* and 62*b* (see FIG. 6E) rather than three options of A-A", B-B" and C-C" (see FIG. 6D).

In some embodiments, a user may select a portion of the song waveform (or song lyrics) for which they would like to find a match, or may select a portion of the song waveform (or song lyrics) they would like to keep or may select a portion of the song waveform (or song lyrics) they would like to have deleted. The software will seek to find similarities to that user selected segment and/or keep such user selected segment. The words of the song may be displayed and respectively associated with appropriate portions of the song waveform to assist the user in this selection, as described above.

In some embodiment, a user may select a desired final song time and embodiments herein will analyze the various options to shorten the song with the grouped splice points and provide the song closest in length to the desired final song time. In some examples, the song may be slightly increased or decreased (e.g., plus or minus 10%) in speed to accommodate a desired time. In some examples, a detected fade-out of the end of the song may be accelerated to accommodate a desired time.

In some embodiments, a length of a presentation (or portion of a presentation) may be submitted or otherwise determined by various factors, and the desired final song(s) time may be used to adjust the length(s) of song(s) to fit the length of the presentation. For example, the user may select a time $T_S$ per slide (e.g. three seconds per slide) and provide a number N of slides. The length of one or more selected songs may be adjusted to approximate the overall time of the slide show ($N \times T_S$). After adjusting the length of the songs, the total song length may not exactly match ($N \times T_S$) due to splice point restrictions (or other criteria, such as user input criteria to maintain a minimum song length or to maintain certain lyrics). To provide an exact match between the lengths of the selected one or more songs, after shortening these songs, the difference between the total length of the songs may be calculated and the time $T_S$ per slide may be adjusted to $T_S'$ so that $N \times T_S'$ equals the total length of the songs. Alternatively, the time per slide need not be the same for each slide. In addition, video clips may by themselves establish a presentation length, or may be inserted in a slide show to affect the time of the overall presentation (e.g., the presentation length may be $N \times T_S + T_V$, where $T_V$ equals the length of the video clips of the presentation), which may be used to adjust length(s) of song(s). Similarly, after length adjustment of the songs to be close to the desired time of presentation, the time per slide may be adjusted to $T_S'$ so that $N \times T_S' + T_V$=the total time of the song lengths.

Figure 13:
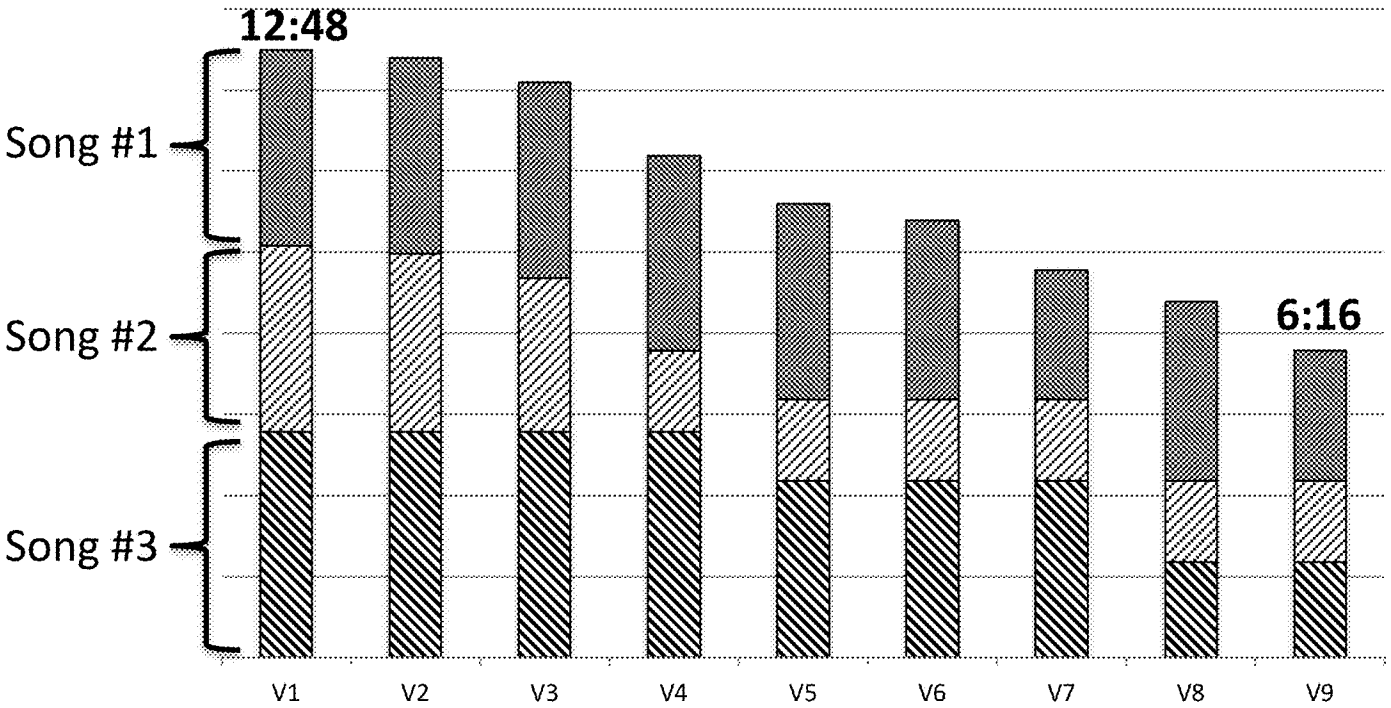
FIG. 13 illustrates an example where a computer system has analyzed three songs to determine shortened (or lengthened) versions of each of the songs.

In some embodiments, the desired time over multiple songs may be provided or selected by the user. For example, users may wish to create a slideshow that consists of multiple identified songs. The user may provide the songs and or the identity of the songs to a computer system (e.g., a web server). The user can select a desired target length of the video and/or slideshow and the computer system will optimize length of multiple songs to attempt to achieve that target. For example, each of the multiple songs may be analyzed to determine optimum or valid splice points and determine a resulting song length if using that results if using the splice points to shorten (or lengthen) the song. This may be done multiple times for each song, resulting in multiple song lengths for each song. Then, each version of the song may be matched with other versions to provide options for modifying the song length of the set of songs. The computer may determine the set of versions (or provide several sets of versions) that best matches the desired set length. Alternatively, the computer system may provide sets of versions of songs and corresponding set lengths to a user who may then select a desired set (e.g., corresponding to a desired song set length of time). FIG. 13 illustrates an example where a computer system has analyzed songs #1, #2 and #3 to determine shortened (or lengthened) versions of each of the songs. By selecting from these versions, the computer system provides nine sets of songs (V1 to V9), each set having a different length in time from 12 minutes and 48 seconds (V1) to 6 minutes and 16 seconds (V9). The computer may automatically provide the set of songs that is closest (or just longer than) a desired time submitted by a user (or calculated from user submitted data, as described elsewhere herein). Alternatively, a user may select one of the sets of songs (one of V1 to V9) (e.g., based upon the length of time of the set). The set of songs may be provided as a new digital file or may be provided as a set of instructions to play the original songs in a manner corresponding to the set. The set of songs may be associated with a slide show.

In some embodiments, songs may be adjusted to provide a shortened, or repetitive portion of a song to create a ringtone for a phone. In some examples, the method may include analysis of the song for similarity matches and then finds the best similarity matches that correspond to a chorus, which is commonly referred to as the "hook" in a song. The ringtone detector may enable a telephonic device such as a smart phone to begin playing the audio at the detected beginning of the hook, and play it until the end before looping back and replaying until the call has been answered or has timed out. The ringtone playback application may use the original song digital file stored in a music file library by providing a set of instructions (e.g., a pointer list to locations within the song digital file) to play the desired portion of the song and repeat the same. Ringtones may also include two or more discrete segments of a song (e.g., with a section of the song therebetween skipped or deleted).

Figure 4:
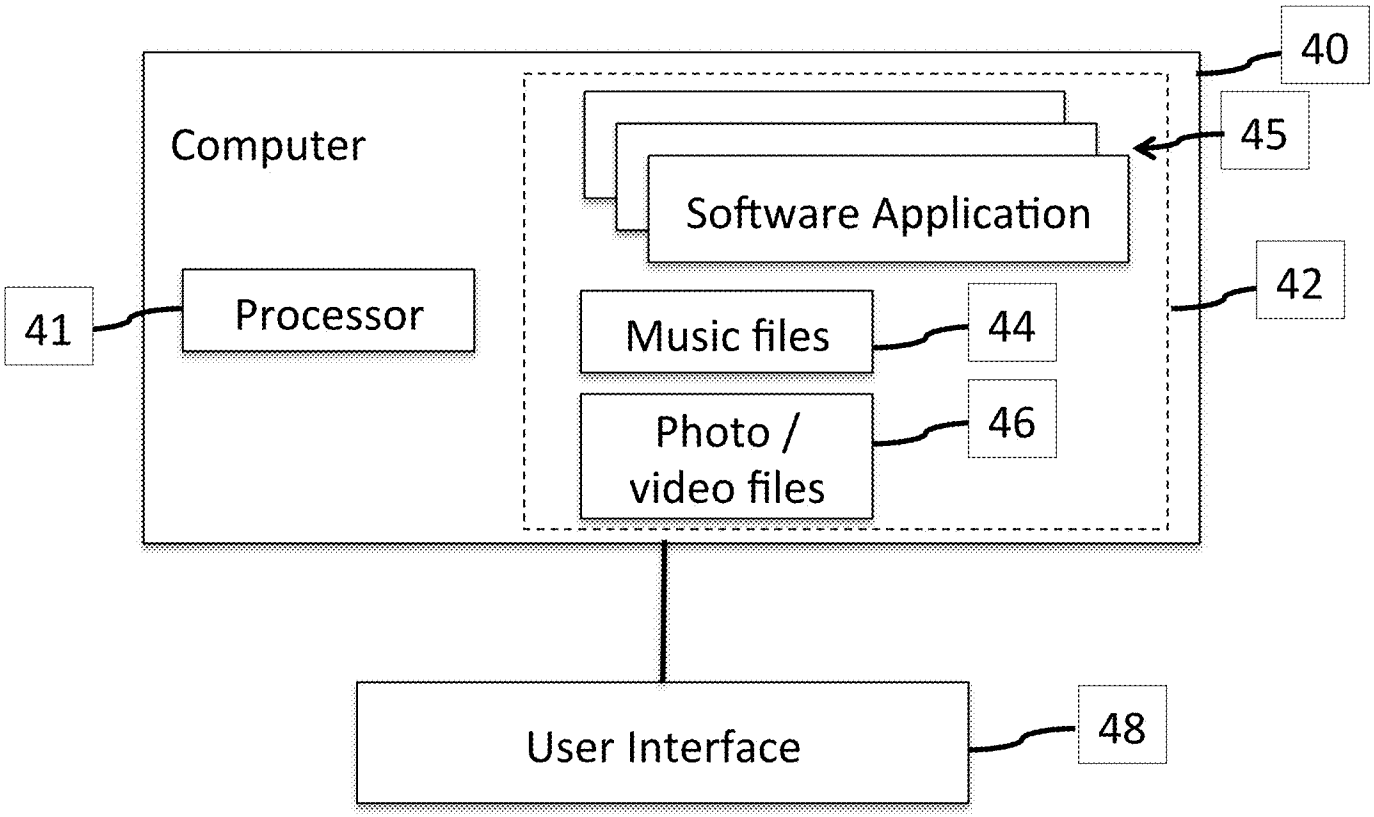
FIG. 4 illustrates a computer 40 according to an embodiment of the invention.

FIG. 4 illustrates a computer 40 according to an embodiment of the invention comprising a processor 41 and non-transitory, tangible, computer readable medium 42 which may comprise a hard disk, non-volatile memory (e.g., NAND flash memory and/or working memory (e.g., DRAM). Computer 40 may be configured by one or more software applications 45. The software applications 45 may be stored in the computer readable medium 42, such as permanently (e.g., in a hard drive of the computer) and/or temporarily (e.g., in the working memory of the computer). Processor 41 may perform a series of actions in response to program code stored in computer readable medium 42 (e.g., such as code of the software applications 45) to execute some or all of methods described herein. According to one example, a software application 45 may comprise a song length adjustment application (e.g., comprising software) to perform one or more of the song adjustment methods described herein. The same software application 45 may comprise an audio-visual creation application, such as a slide show application. For purposes of ease of description, a slide-show application will be used as a representative example of an audio-visual creation application, however, the related description is applicable to other types of audio-visual creation applications. The slide-show application may allow a user to generate a slide show of still images and/or video accompanied by a song whose length has been altered, e.g., as described according to the methods herein. Thus, the slide show application may include functionality to allow an original song to have its length altered. Alternatively, the song length adjustment application and the slide show application may be separate software applications 45. The slide show application may cooperate/communicate with the song length adjustment application automatically (e.g, through an application programming interface (API)) or via actions of a user via user interface 48. The song length adjustment application may be embedded in and/or cooperate with other types of audio-visual creation applications, such as video production software (for the production of commercial or movies, or to share home movies with friends), may be a stand-alone software application or part of an audio software application (e.g., to create music or a "remix" of a song).

FIG. 4 also illustrates storage 44 for music files and storage 46 for photo and/or videos, allowing a song length adjustment application to access the same. A user interface 48 may allow a user to interact with the song length adjustment application 45 to provide a song and parameters for adjusting the length of the song. Details of such options are described elsewhere herein.

Although FIG. 4 illustrates the song length adjustment application stored in memory of the computer 40, in alternative embodiments, the song length adjustment application may be provided on a non-transitory computer readable medium, such as on a compact disc (CD), DVD, USB flash memory, or other non-transitory computer readable medium, or may be provided on a server accessed over the internet.

Figure 5:
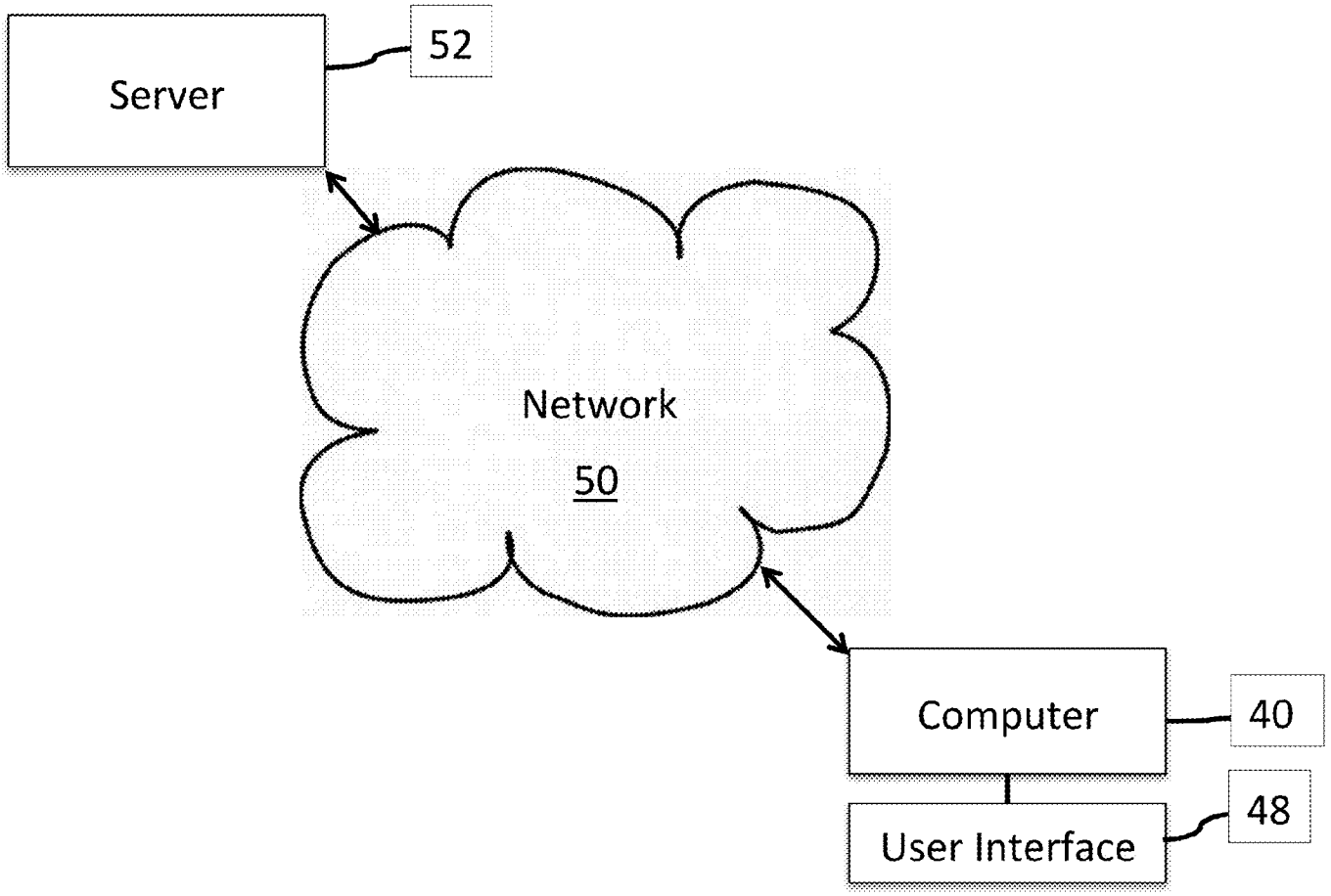
FIG. 5 illustrates an alternative embodiment comprising a computer with user interface in communication with a server over a network.

FIG. 5 illustrates an alternative embodiment, showing a computer 40 with user interface 48 (such as that shown in FIG. 4) in communication with a server 52 over network 50. All or some of the functionality of the computer 40 described with respect to FIG. 4 may be placed on server 52, including the song length adjustment application, the audio-visual creation application (such as a slide show application) whether or not combined with the song length adjustment application, storage for music files and/or storage for video and/or photos. In one embodiment, the song length adjustment application resides on server 52 and communicates with an audio-visual creation application, such as a slide show application on computer 40 via an API. A user may select a song for length adjustment. The song may be previously purchased and part of the user's music files stored in computer storage 44. The computer 40 may transmit the selected song or an identity of a song to the song length adjustment application on server 52, which, in return, may communicate a length adjusted song or information to create a song of adjusted length (such as several groups of splice points).

For example, the computer 40 may include a song in the user's music files 44 stored in computer readable medium 42. The computer 40 may transmit the identity of the song (as a result of a user selection) to the server 52. The song length adjustment application on server 52 may access the song from its own music files (or purchase the song if it does not exist in the music files) and determine one or more groups splice points based on the methodology described herein. All or some of the groups of splice points may be transmitted to computer 40, which may then use the groups of splice points to adjust the length of the song (such as disclosed herein). The groups of splice points of the song may be stored with server 52 so that similarity analyses described herein need not be repeated at a later time when the server 52 receives instructions regarding adjustment of the length of the same song—the same groups of splice points previously calculated may be used to adjust the length of the song for a different user, who may have different criteria for altering the length of the song.

As shown in FIG. 11A, server 52 may maintain a database 110 containing information altering the length of a plurality of songs. The database 110 may include a list of song titles 112 (or other information to identify the song). Each song may be associated with a plurality of altered times 114 describing a length of time for a previously calculated length altered song (e.g., as described herein). Each of the altered times 114 may be associated with information 116 to obtain the length altered song. Information 116 may describe portions of the song to delete or skip (e.g., a list of time codes describing beginning and end times of audio segments to skip when playing the song) and/or a set of pointers or instructions describing how to deviate from the original song sequence to provide a new sequence of play for portions of the song. This information 116 may be previously obtained by analyzing the song waveform 60 as described herein. After analyzing the waveform to obtain the information describing the one or more shortened versions, the original song may be discarded. In addition, the plural shortened song itself may be optionally stored with server 52 and associated with the appropriate one of times 114, or may be generated upon selection by a user using information 116 (either by the server 52 or by an application on a user's computer 40). Alternatively, only the information describing the one or more shorted versions may be kept along with the identification of the song. Thus, the original song and other versions of the song need not be stored by server 52.

Figure 11C:
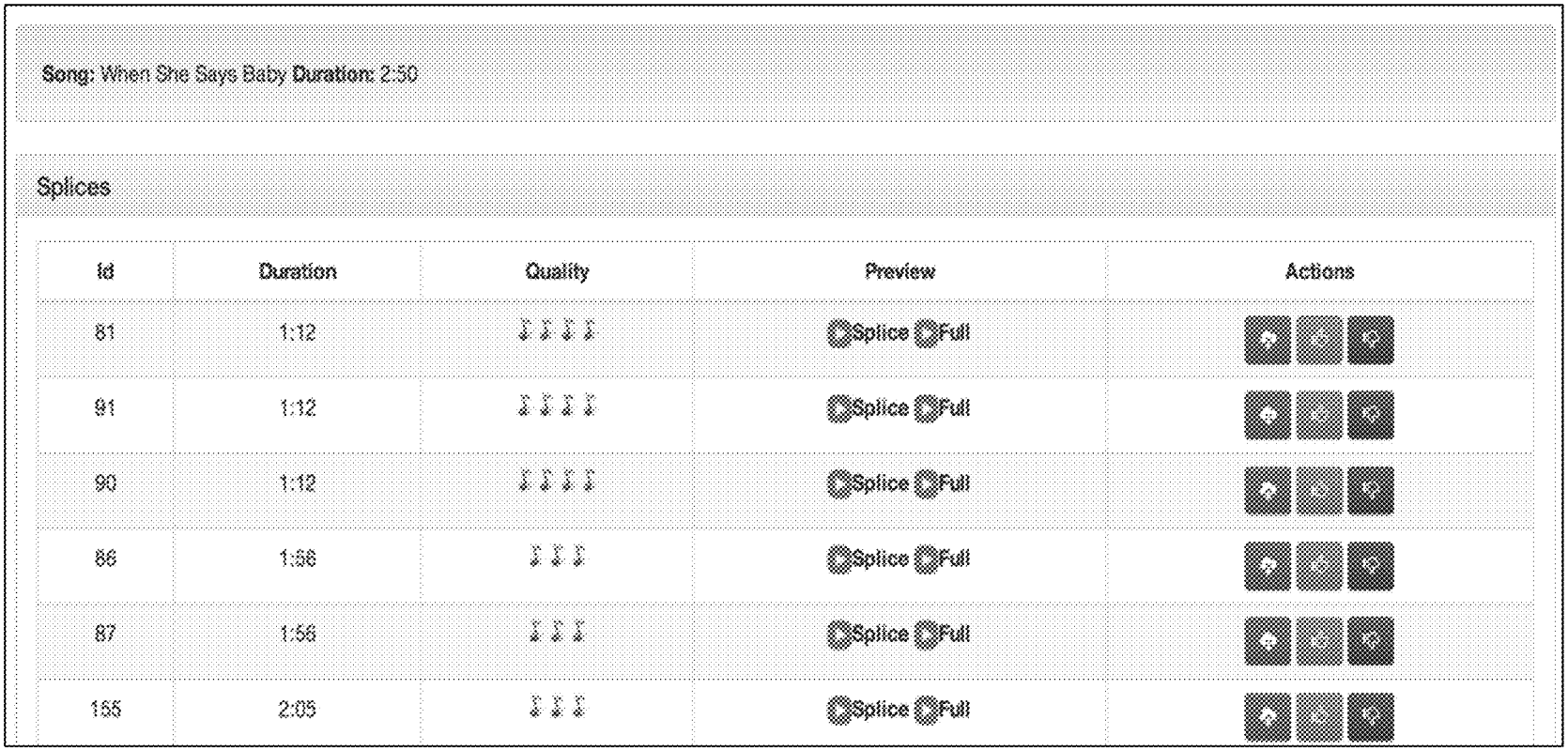

In another example, database 110 may include record entries for user ratings of the shortened versions of the song. As shown in FIG. 11B, the database may keep track of positive ratings 118 and negative ratings 120 provided by user feedback. For example, after obtaining and listening to a shortened song via the server 52, an application on the user's computer 40 may allow the user to select a "thumbs up" button or "thumbs down" button via user interface 48. FIG. 11C illustrates an example user interface displaying song versions (ID); a duration of each song version; an estimated quality of such shortened song version (e.g., a ranking of the quality of detection of an alteration of the song by a listener, e.g., detecting the splice point in listening to the song); a preview option allowing a user to listen to a portion of the song containing the spice point or to listen to the full version of the song (e.g., by clicking on the appropriate "splice" or "full" button; and action icons allowing (via clicking on the icon) a user to download a version of the song, provide a positive rating of the version of the song (e.g., clicking on a "thumbs up" symbol) or to provide a negative rating of the version of the song (e.g., clicking on a "thumbs down" symbol). Such information may be transmitted to the server 52 and used to increment the appropriate positive rating 118 or negative rating 120 value. In selecting a shortened song, a user may review the ratings. Alternatively, the server 52 may delete or elect not to provide an option for a shortened song that receives too many negative ratings (such as the 2:22 version of "Song A" and the 2:37 version of "Song B"). Alternatively, the server 52 may provide the best ranked shortened song that is within a range of a time preference provided by the user. Other mechanisms for receiving user ratings are also contemplated, such as ranking by a number of stars (e.g., selecting zero to four stars representing a scale of low to high quality).

It should be emphasized that many of the embodiments disclosed herein are not mutually exclusive but are useable with one another, in whole or in part—it is impracticable to set forth a separate description to for each possible combination of features of the embodiments described herein, and thus a particular combination of features according to the invention may be described in connection with separate embodiments in this disclosure. While example embodiments have been particularly shown and described, it will be understood by one of ordinary skill in the art that variations in form and detail may be made therein without departing from the spirit and scope of the attached claims.

What is claimed is:

1. A method of altering a duration of a song, comprising:

receiving a request to alter a duration of a first song, the first song being stored as a first digital file;

automatically analyzing the first song to determine one or more pairs of splice locations within the first song including comparing a first portion of the first digital file with plural parts of a remaining portion of the first digital file to determine a plurality of similarity values, each similarity value representing a degree of similarity of the first portion with a corresponding part of the remaining portion of the first digital file; and altering the duration of the first song in response to a selection of at least a first pair of splice locations of the one or more pairs of splice locations, wherein each of the plurality of similarity values is determined by an extent of overlap of an area of a waveform corresponding to the first portion of the first digital file with an area of a waveform corresponding to a corresponding one of the plural parts of the remaining portion of the first digital file.

2. The method of claim 1, wherein automatically analyzing includes determining for each of the plurality of similarity values an associated locational relationship between the first portion and one of the plural parts of the remaining portion of the first digital file.

3. The method of claim 1, wherein each of the plurality of similarity values is determined by performing a cross correlation calculation with the first portion of the first digital file and the remaining portion.

4. The method of claim 1, further comprising:

storing instructions for playing the first song in a computer indicating a deviation from an original play sequence of the first song to provide a new sequence of play of portions of the first song using at least a first pair of splice locations of the one or more pair of splice locations; and altering the duration of the first song by accessing the instructions for playing the first song, including skipping a portion of the first song between the first pair of splice locations.

5. The method of claim 1, wherein altering the duration of the first song includes lengthening the first song by providing a second digital file comprised of the first digital file with a portion of the first digital file between a selected pair of splice locations duplicated.

6. The method of claim 1, further comprising:

playing with a phone the first song of altered duration as a ringtone upon receiving a phone call.

7. The method of claim 1, further comprising:

providing information to display the one or more pairs of splice locations to a user; and receiving a selection of a pair of splice locations from the user.

8. The method of claim 1, further comprising comparing plural pairs of splice locations to determine similar pairs of splice locations.

9. The method of claim 8, wherein determining similar pairs of splice locations comprises determining a segment duration between each pair of splice locations and comparing the determined segment durations.

10. The method of claim 9, further comprising clustering similar pairs of splice locations into a pair of splice objects.

11. The method of claim 10, wherein the selection of the first pair of splice locations comprises selecting the pair of splice objects.

12. The method of claim 10, further comprising:

providing a list of pairs of splice locations, wherein the step of clustering comprises providing only one of the similar pairs of a splice object in the list.

13. A method of altering a duration of a song, comprising:

receiving a request to alter a duration of a first song, the first song being stored as a first digital file;

automatically analyzing the first song to determine one or more pairs of splice locations within the first song including comparing a first portion of the first digital file with plural parts of a remaining portion of the first digital file to determine a plurality of similarity values, each similarity value representing a degree of similarity of the first portion with a corresponding part of the remaining portion of the first digital file; and altering the duration of the first song in response to a selection of at least a first pair of splice locations of the one or more pairs of splice locations, wherein each of the plurality of similarity values is determined by determining a shared area of a waveform corresponding to the first portion of the first digital file and waveforms corresponding to a respective one of the plural parts of the remaining portion of the first digital file.

14. The method of claim 13, wherein altering the duration of the first song includes providing a second digital file comprised of the first digital file with a portion of the first digital file between a selected pair of splice locations removed.

15. The method of claim 13, further comprising altering the duration of the first song by repeating the first song between the pair of splice locations.

16. The method of claim 13, wherein automatically analyzing includes comparing a plural portions of the first digital file with plural parts of a remaining portion of the first digital file to determine, for each portion of the first digital file, a plurality of similarity values, each similarity value representing a degree of similarity of the corresponding portion with a corresponding part of the remaining portion.

17. A method of altering a duration of a sequential play of a group of songs, comprising:

receiving a request to alter a duration of the sequential play of the group of songs, including a first song, each song of the group of songs being stored as a digital file;

obtaining a target duration of the sequential play of the group of songs;

for each song of the group of songs, automatically analyzing each song of the group of songs to determine one or more pairs of splice locations within each song including comparing one or more portions of the corresponding digital file with a remainder of the corresponding digital file; and altering the duration of the sequential play of the group of songs to approximate or equal the target duration by altering the duration of at least the first song in response to a selection of the first pair of splice locations within the first song.

18. The method of claim 17, further comprising altering the duration of at least the first song and a second song of the group of songs in response to a selection of at the first pair of splice locations within the first song and in response to a selection of a second pair of splice locations within the second song.

19. The method of claim 18, further comprising receiving a user input reflecting the target duration, wherein the selection of the first pair of splice locations within the first song and the selection of the second pair of splice locations within the second song is automatically performed in response to the target duration.

20. The method of claim 19, wherein the user input comprises the target duration.

21. The method of claim 19, wherein the user input is one or more parameters from which the target duration is calculated.

22. The method of claim 18, further comprising associating the group of songs with altered duration of sequential play with one or more of video and image files.

23. The method of claim 18, further comprising creating a slide show using the group of songs with altered duration of sequential play.

24. A method of altering a duration of a song, comprising:

receiving a request to alter a duration of a first song, the first song being stored as a first digital file;

automatically analyzing the first song to determine one or more pairs of splice locations within the first song including comparing one or more portions of the first digital file with a remainder of the first digital file; and altering the duration of the first song in response to a selection of at least a first pair of splice locations of the one or more pairs of splice locations;

wherein the step of automatically analyzing the first song is performed prior to receiving the request to alter the first song and wherein altering the duration of the first song in response to the selection is performed without reanalyzing the first song.

25. The method of claim 24, wherein altering the duration of the first song includes providing instructions for playing the first song, including duplicating a portion of the first song between a selected pair of splice locations.

26. The method of claim 24, further comprising:

providing display information comprising a timeline representation of the song and a plurality of splice location indicators associated with the timeline representation of the song; and receiving a selection of two of the splice location indicators.

27. The method of claim 26, further comprising receiving a user input responsive to a user manipulation of a cursor to match two of the splice location indicators.

28. The method of claim 24, further comprising:

automatically analyzing a plurality of songs, including the first song, to determine, for each song, at least one version of the corresponding song having an altered duration and storing altered song duration information corresponding to each version, including first altered song duration information corresponding to a version of the first song having an altered duration; and then receiving the request to alter a duration of the first song; and then providing the first altered song duration information.

29. The method of claim 28, wherein the altered song duration information comprises a quality ranking.

30. The method of claim 29, further comprising receiving user feedback regarding a version of a song having an altered duration and changing a quality ranking in response to the user feedback.

31. The method of claim 24, further comprising:

providing plural versions of the first song with an altered duration, each version corresponding to a different pair of splice locations of the one or more splice locations; and receiving one or more ratings from one or more users of at least one of the plural versions indicating a quality of the at least one of the plural versions.

32. The method of claim 31, further comprising:

providing a list of the plural versions of the first song with an altered duration, the list being responsive to the one or more ratings of the one or more users.

33. The method of claim 32, wherein the order of the list is responsive to the one or more ratings of the one or more users.

34. The method of claim 32, wherein each entry of the list includes a version indicator associated with a corresponding version of the first song with an altered duration, and a quality value associated with the version indicator, wherein the quality value is responsive to the one or more ratings of the one or more users.

35. The method of claim 32, wherein the user rating comprises a user selection of one of a positive icon and a negative icon via a user interface.

36. A non-transitory, tangible, computer readable storage medium comprising a program that when executed by a computer system performs the method of claim 1.

37. A computer system comprising:

the non-transitory, tangible, computer readable storage medium of claim 36;

a processor configured to execute the program stored in the non-transitory, tangible, computer readable storage medium; and an interface connected to a network to receive the request to alter the duration of the first song.

* * * * *